US006382360B2

(12) United States Patent
Kobayashi et al.

(10) Patent No.: US 6,382,360 B2
(45) Date of Patent: May 7, 2002

(54) TRACTION TYPE ELEVATOR APPARATUS

(75) Inventors: Kiyoshi Kobayashi; Tadashi Munakata; Kosei Kamimura; Yasuyuki Wagatsuma; Hisao Yamamoto; Koji Yajima, all of Tokyo (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/816,218

(22) Filed: Mar. 26, 2001

Related U.S. Application Data

(62) Division of application No. 09/300,072, filed on Apr. 27, 1999, now Pat. No. 6,247,557.

(30) Foreign Application Priority Data

Apr. 28, 1998 (JP) ..... 10-119239
Sep. 3, 1998 (JP) ..... 10-249938

(51) Int. Cl.[7] ..... B66B 7/06; B66B 11/08

(52) U.S. Cl. ..... 187/266; 187/251; 187/254; 187/264

(58) Field of Search ..... 187/251, 254, 187/266, 411, 264

(56) References Cited

FOREIGN PATENT DOCUMENTS

| | | | | |
|---|---|---|---|---|
| EP | 0 539 238 | A2 | | 4/1993 |
| EP | 07 117957 | | | 5/1995 |
| EP | 0 688 735 | A2 | | 12/1995 |
| EP | 0 719 724 | A1 | | 7/1996 |
| EP | 08 175623 | | | 7/1996 |
| EP | 0 749 931 | A2 | | 12/1996 |
| EP | 0 779 233 | A2 | | 6/1997 |
| EP | 10 087240 | | | 4/1998 |
| JP | 9-278310 | A | * | 10/1997 |
| JP | 10-008755 | | | 1/1998 |
| JP | 10-304641 | A | * | 11/1998 |
| JP | 2000-247559 | A | * | 9/2000 |
| WO | 97/11020 | | | 3/1997 |

* cited by examiner

*Primary Examiner*—Eileen D. Lillis
*Assistant Examiner*—Thuy V. Tran
(74) *Attorney, Agent, or Firm*—Oblon, Spivak, McClelland, Maier & Neustadt, P.C.

(57) ABSTRACT

An elevator apparatus is provided with an elevator path having a restricted height. Under a roping ratio of 1:1, a thin driving unit having a traction sheave 1 and a driving mechanism 2 is positioned between an inner wall 3*a* of the elevator path 3 and a space occupied by an elevator car 4 rising and falling in the elevator path 3. One end of a suspension rope 7 is fixed to the elevator car 4 in a position below a ceiling 4*c* of the elevator car 4. With the arrangement, the car 4 can move close to the ceiling 4*c* of the elevator car 4 effectively. Further, it is possible to reduce respective heights of the elevator path 3 and a building equipped with the elevator apparatus.

1 Claim, 27 Drawing Sheets

TRACTION TYPE ELEVATOR APPARATUS

This application is a division of Ser. No. 09/300,072, filed Apr. 27, 1999, now U.S. Pat. No 6,247,557.

BACKGROUND OF THE INVENTION

1. Field of the Invention

The present invention relates to an improvement of a traction type of elevator apparatus having a driving mechanism disposed in an elevator path (or hoistway) of the apparatus.

2. Description of Related Art

In recent years, especially in urban areas, it has been required to make the effective use of buildings per se. For example, for even an elevator's machine room standing on the housetop etc., the right to sunlight, the appearance of beauty, or the like have been taken into consideration.

Under such a situation, hitherto, there have been developed a variety of attempts to accommodate a control unit in the elevator path without establishing the elevator's machine room in order to provide a compact elevator apparatus. For example, Japanese Patent No. 2593288 discloses a traction sheave elevator, as shown in FIG. 1. In the figure, a flattened driving mechanism 2 having a traction sheave 1 is disposed between a side wall 3*a* in an elevator path 3 and a space defined by projected planes of an elevator car 4 in the upward and downward directions. A hoisting (suspension) rope 7 is wound about a sheave 5*a* beneath the car 4 and a sheave 5*b* above a balance weight 6, while both ends of the hoisting rope 7 are fixed on a top wall 3*b* defining the elevator path 3. Note, according to the arrangement shown in FIG. 1, a pit 3*c* in the elevator path 3 is positioned under a level 3*d* of the first floor (1F).

The elevator of FIG. 1 does adopt a structure where the car 4 is driven like a movable pulley while winding the suspension rope 7 about the sheave 5*a* under the car 4. Owing to this arrangement, it is possible to reduce the capacity of a motor of the driving mechanism relatively and minimize a space occupied by the driving mechanism, together with the effective use of the space above the car 4.

Japanese Unexamined Patent Publication (kokai) No. 9-156855 discloses another elevator apparatus shown in FIG. 2. In the apparatus, the flattened driving mechanism 2 is arranged in the upper space of the balance weight 6 and adapted so as to suspend the car 4 through turning sheaves 8*a*, 8*b* and 8*c*.

In this way, since the driving mechanism 2 having the traction sheave 1 is disposed between a side wall 3*a* in an elevator path 3 and a space defined by projected planes of an elevator car 4 in the upward and downward directions, the arrangement allows to minimize a space that the whole apparatus does occupy without providing the machine room on the roof, so that the elevator apparatus can be provided while exhibiting high efficiency in utilizing the space.

In the former elevator apparatus, however, since the velocity of the moving rope is twice as much as that of the elevator car due to the adoption of "moving-pulley" driving system in accordance with the roping ratio of 2:1, various problems would be raised in case of the requirement for a high-speed elevator. In addition, as the driving mechanism is accommodated in the space between the projected planes of the elevator car and the inner wall of the elevator path, a problem still remains in terms of the requirements for the mechanism having a large capacity.

While, in the latter elevator apparatus, the velocity of the suspending rope is equal to that of the elevator car owing to the provision of the turning sheaves. Nevertheless, there is remained a problem in terms of effective use of space in the elevator path because the apparatus requires a space for accommodating the turning sheaves on the upper side of the elevator path.

SUMMARY OF THE INVENTION

It is therefore an object of the present invention to provide an elevator apparatus which is equipped with no machine room, so that it is possible to restrict the height of an elevator path from increasing and also drive an elevator car at high speed.

The object of the present invention described above can be accomplished by an elevator apparatus comprising:

a pair of elevator guide rails disposed in an elevator path;

an elevator car for rising and falling along the elevator guide rails in the elevator path;

weight guide rails disposed in an elevator path;

at least one balance weight for rising and falling along the weight guide rails in the elevator path;

at least one suspension rope having one end fixed to the elevator car and another end fixed to the balance weight; and at least one driving unit for driving a traction sheave about which the suspension rope is wound;

wherein the driving unit is positioned between an inner wall of the elevator path and a space occupied by the elevator car rising and falling in the elevator path and the driving unit is constructed so as to become thin; and wherein the end of the suspension rope is fixed to the elevator car in a position below a ceiling of the elevator car.

According to the elevator apparatus constructed above, the drive of the elevator car at the same speed as the suspension rope can be realized owing to the achievement of roping ratio of 1:1. In addition, with the arrangement where the elevator car is connected with the suspension rope in a position below the ceiling of the elevator car and there is provided no turning sheave etc. in a space above the elevator car, the upper area of the elevator path can be effectively utilized thereby to provide a high-speed and compact elevator apparatus.

In the present invention, preferably, the driving unit comprises a plurality of driving mechanisms each having a traction sheave and the suspension rope is wound about each traction sheave of the driving mechanisms and finally fixed to the elevator car and the balance weight.

In the present invention, more preferably, the driving mechanisms are arranged up and down in the elevator path, while the suspension rope is wound round the traction sheave associated with the upper driving mechanism with a plurality of turns.

Alternatively, it is also preferable that the driving mechanisms are arranged left and right in the elevator path, so that respective planes of the traction sheaves associated with the left and upper driving mechanism coincide with each other substantially.

In common with the above-mentioned preferable arrangements, since the driving unit is constituted by the plural driving mechanisms, it is possible to realize to provide the elevator apparatus with high-speed operation and large transportation capacity.

In the present invention, it is preferable that one of the elevator guide rails, which is disposed on the side of the driving unit, has a H-shaped cross section and is arranged so that parallel side portions constituting the H-shaped cross section are opposite to a side wall of the elevator and that the elevator car is provided with two pairs of rollers for guiding the elevator car, each pair of rollers interposing one of the parallel side portions between the rollers on left and right sides of the parallel side portion.

In this case, owing to the configuration of the specified elevator guide rail, the elevator apparatus is provided with great rigidity, so that it can travel more stably.

In the above-mentioned arrangement, it is more preferable that the elevator apparatus further comprises a L-shaped frame for mounting and carrying the elevator car thereon, the frame consisting of a vertical beam and a horizontal beam and that the horizontal beam is provided, at a tip thereof, with other rollers between which the other elevator guide rail disposed on the opposite side of the driving unit is interposed to guide the elevator car.

In this case, owing to the provision of the L-shaped flame, the elevator apparatus can rise and fall more stably and the elevator car can be carried with such a simple structure, strongly.

In the present invention, it is preferable that the suspension rope is divided into two routes of ropes whose ends are respectively fixed to different positions on opposite outer faces of the elevator car, while the different positions are symmetrical to each other in plan view of the elevator car. In this case, with the above structure and arrangement of the suspension rope, it is possible to provide the elevator car with its stable posture.

In the above elevator apparatus, more preferably, the driving unit is disposed in the vicinity of a first floor in the elevator path. In this case, owing to the positioning of the driving unit, it is possible to reduce the height of the ceiling of the elevator path to a minimum. Additionally, the arrangement allows a worker to execute the maintenance and inspecting operation for the elevator apparatus near the ground, whereby the burden on the worker can be lightened.

In the present invention, it is preferable that the weight guide rails are arranged so as to extend along opposite inner walls defining the elevator path and that the suspension ropes have respective ends fixed to the balance weights in pairs rising and falling under guidance of the weight guide rails and respective other ends fixed to the elevator car through the driving units in pairs. In this case, since the driving units in pairs are respectively connected to the balance weights in pairs, it is possible to provide the elevator apparatus having large transportation capacity.

Similarly, it is preferable that the suspension ropes in pairs have respective ends fixed on opposite outer faces of the elevator car and have respective other ends fixed on the single balance weight through the traction sheaves of the driving units provided corresponding to the opposite outer faces, the balance weight being attached along an inner wall of the elevator path behind the elevator car. Also in this preferable form, it is possible to provide the elevator apparatus having large transportation capacity.

In the present invention, preferably, the driving unit is attached on either one of an inner wall and a roof wall of the elevator path.

With the attachment of the driving unit on the side of the elevator path, the burden applied on the elevator guide rails is lightened thereby to reduce the weight of the driving unit.

According to the invention, there is also provided an elevator apparatus comprising:

a pair of elevator guide rails disposed in an elevator path;

an elevator car for rising and falling along the elevator guide rails in the elevator path;

weight guide rails disposed in an elevator path;

at least one balance weight for rising and falling along the weight guide rails in the elevator path;

at least one suspension rope having one end fixed to the elevator car and another end fixed to the balance weight; and at least one driving unit for driving a traction sheave about which the suspension rope is wound;

wherein the driving unit is disposed in a pit of the elevator path; and wherein both ends of the suspension rope wound about the traction sheave are fixed to the elevator car's position below a ceiling of the elevator car and the balance weight through respective turning sheaves which are positioned above the elevator path.

Also in this elevator apparatus constructed above, the drive of the elevator car at the same speed as the suspension rope can be realized owing to the achievement of roping ratio of 1:1. In addition, with the arrangement where the driving unit is disposed in the pit of the elevator path and the elevator car is connected with the suspension rope in the position below the ceiling of the elevator car, the upper area of the elevator path can be effectively utilized thereby to provide the high-speed and large-capacity elevator apparatus.

The object of the present invention described above can be also accomplished by an elevator apparatus comprising:

a pair of elevator guide rails disposed in an elevator path;

an elevator car for rising and falling along the elevator guide rails in the elevator path;

weight guide rails disposed in an elevator path;

a balance weight for rising and falling along the weight guide rails in the elevator path;

a suspension rope for suspending the elevator car and the balance weight;

a driving unit for driving a traction sheave about which the suspension rope is wound; and turning sheaves arranged on a side face of the elevator car and the balance weight;

wherein the driving unit is positioned between a side wall of the elevator path and a space occupied by the elevator car rising and falling in the elevator path and constructed so as to become thin; and wherein the suspension rope is wound round the turning sheaves on both elevator car and balance weight, while both ends of the suspension rope are connected to supporting members mounted on an upper end of the elevator path.

Similarly, the object of the present invention described above can be also accomplished by an elevator apparatus comprising:

a pair of elevator guide rails disposed in an elevator path;

an elevator car for rising and falling along the elevator guide rails in the elevator path;

weight guide rails disposed in an elevator path;

a balance weight for rising and falling along the weight guide rails in the elevator path;

a suspension rope for suspending the elevator car and the balance weight;

a driving unit for driving a traction sheave about which the suspension rope is wound; and turning sheaves arranged on a back face of the elevator car and the balance weight;

wherein the driving unit is positioned between a back wall of the elevator path and a space occupied by the elevator car rising and falling in the elevator path and the driving unit is constructed so as to become thin; and wherein the suspension rope is wound round the turning sheaves on the back face of the elevator car and the balance weight, while both ends of the suspension rope are connected to supporting members mounted on an upper end of the elevator path.

Similarly, the object of the present invention described above can be also accomplished by an elevator apparatus comprising:

a pair of elevator guide rails disposed in an elevator path;

an elevator car for rising and falling along the elevator guide rails in the elevator path;

weight guide rails disposed in an elevator path;

a balance weight for rising and falling along the weight guide rails in the elevator path;

a suspension rope for suspending the elevator car and the balance weight;

a driving unit for driving a traction sheave about which the suspension rope is wound; and turning sheaves arranged on both side faces of the elevator car, a bottom face thereof and the balance weight;

wherein the driving unit is positioned between a side wall of the elevator path and a space occupied by the elevator car rising and falling in the elevator path and the driving unit is constructed so as to become thin; and wherein the suspension rope is wound round the turning sheaves on the elevator car and the balance weight, while both ends of the suspension rope are connected to supporting members mounted on an upper end of the elevator path.

Similarly, the object of the present invention described above can be also accomplished by an elevator apparatus comprising:

a pair of elevator guide rails disposed in an elevator path;

an elevator car for rising and falling along the elevator guide rails in the elevator path;

weight guide rails disposed in an elevator path;

a balance weight for rising and falling along the weight guide rails in the elevator path;

a suspension rope for suspending the elevator car and the balance weight;

a driving unit for driving a traction sheave about which the suspension rope is wound; and turning sheaves arranged on both side faces of the elevator car, a ceiling face thereof and the balance weight;

wherein the driving unit is positioned between a side wall of the elevator path and a space occupied by the elevator car rising and falling in the elevator path and the driving unit is constructed so as to become thin; and wherein the suspension rope is wound round the turning sheaves on the elevator car and the balance weight, while both ends of the suspension rope are connected to supporting members mounted on an upper end of the elevator path.

Similarly, the object of the present invention described above can be also accomplished by an elevator apparatus comprising:

a pair of elevator guide rails disposed in an elevator path;

an elevator car for rising and falling along the elevator guide rails in the elevator path;

weight guide rails disposed in an elevator path;

a balance weight for rising and falling along the weight guide rails in the elevator path;

a suspension rope for suspending the elevator car and the balance weight;

a driving unit for driving a traction sheave about which the suspension rope is wound; and turning sheaves arranged on both side faces of the elevator car, a back face thereof and the balance weight;

wherein the driving unit is positioned between a back wall of the elevator path and a space occupied by the elevator car rising and falling in the elevator path and the driving unit is constructed so as to become thin; and wherein the suspension rope is wound round the turning sheaves on the elevator car and the balance weight, while both ends of the suspension rope are connected to supporting members mounted on an upper end of the elevator path.

Similarly, the object of the present invention described above can be also accomplished by an elevator apparatus comprising:

a pair of elevator guide rails disposed in an elevator path;

an elevator car for rising and falling along the elevator guide rails in the elevator path;

weight guide rails disposed in an elevator path;

a balance weight for rising and falling along the weight guide rails in the elevator path;

a suspension rope for suspending the elevator car and the balance weight;

a driving unit for driving a traction sheave about which the suspension rope is wound; and turning sheaves arranged on a side face of the elevator car, a back face thereof, a bottom face thereof and the balance weight;

wherein the driving unit is positioned between either one of a back and side walls of the elevator path and a space occupied by the elevator car rising and falling in the elevator path and the driving unit is constructed so as to become thin; and wherein the suspension rope is wound round the turning sheaves on the elevator car and the balance weight, while both ends of the suspension rope are connected to supporting members mounted on an upper end of the elevator path.

Similarly, the object of the present invention described above can be also accomplished by an elevator apparatus comprising:

a pair of elevator guide rails disposed in an elevator path;

an elevator car for rising and falling along the elevator guide rails in the elevator path;

weight guide rails disposed in an elevator path;

a balance weight for rising and falling along the weight guide rails in the elevator path;

a suspension rope for suspending the elevator car and the balance weight;

a driving unit for driving a traction sheave about which the suspension rope is wound; and turning sheaves arranged on both side faces of the elevator car, a ceiling face thereof and the balance weight;

wherein the driving unit is positioned between a back wall of the elevator path and a space occupied by the elevator car rising and falling in the elevator path and the driving unit is constructed so as to become thin; and wherein the suspension rope is wound round the turning sheaves on the elevator car and the balance weight, while both ends of the suspension rope are connected to supporting members mounted on an upper end of the elevator path.

In common with seven pieces of elevator apparatus mentioned above, there is no need to provide an extra space for the machine room etc. above and below the elevator path, thereby providing the space-saving elevator apparatus.

In common with seven pieces of elevator apparatus mentioned above, preferably, the weight guide rails are disposed on a side wall of the elevator path. This preferable arrangement is applicable to the elevator apparatus with an elevator path having a sufficient room in width.

In common with seven pieces of elevator apparatus mentioned above, preferably, the weight guide rails are disposed on a back wall of the elevator path. This preferable arrangement is applicable to the elevator apparatus with an elevator path having a sufficient room in depth.

In common with the latter five pieces of elevator apparatus, preferably, the turning sheaves on either side face or back face of the elevator car are arranged so as to be symmetrical about a gravity center of the elevator when viewed from an upside of the elevator car. In this case, it is possible to prevent an excessive bias load from acting on the elevator guide rails or the like.

In common with seven pieces of elevator apparatus mentioned above, preferably, the driving unit comprises a plurality of thin-type winders each having a traction sheave. In this case, it is possible to drive the large-sized elevator car under traction.

In the above-mentioned constitution, more preferably, the thin-type winders are driven by a single control device, synchronously. In this case, it is expected to simplify the structure of the elevator apparatus.

These and other objects and features of the present invention will become more fully apparent from the following description and appended claims taken in conjunction with the accompany drawing.

DESCRIPTION OF THE PREFERRED EMBODIMENT

Embodiments of the present invention will be described with reference to the drawings.

First of all, the embodiments described therein are divided broadly into two groups. In common with the first group of the first to seventh embodiments, an suspension (or hoisting) rope has one end coupled to an elevator car in a position below the roof of the elevator car. While, in common with the second group of the subsequent embodiments, the elevator car is provided, on one or both sides thereof, with a turning sheave around which the suspension rope is wound.

Figure 1:
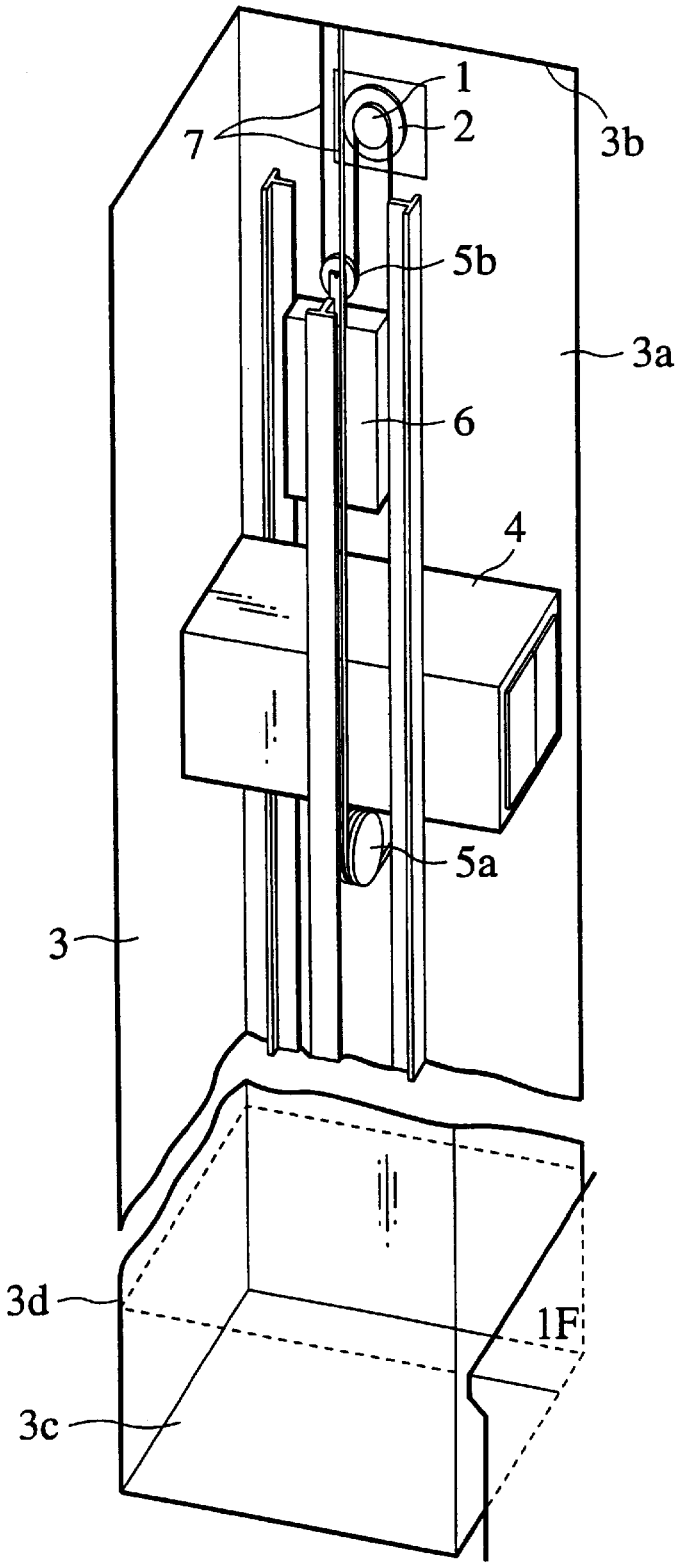
FIG.1 PRIOR ART
FIG. 1 is a perspective view of a conventional elevator apparatus showing an essential part thereof.
Figure 2:
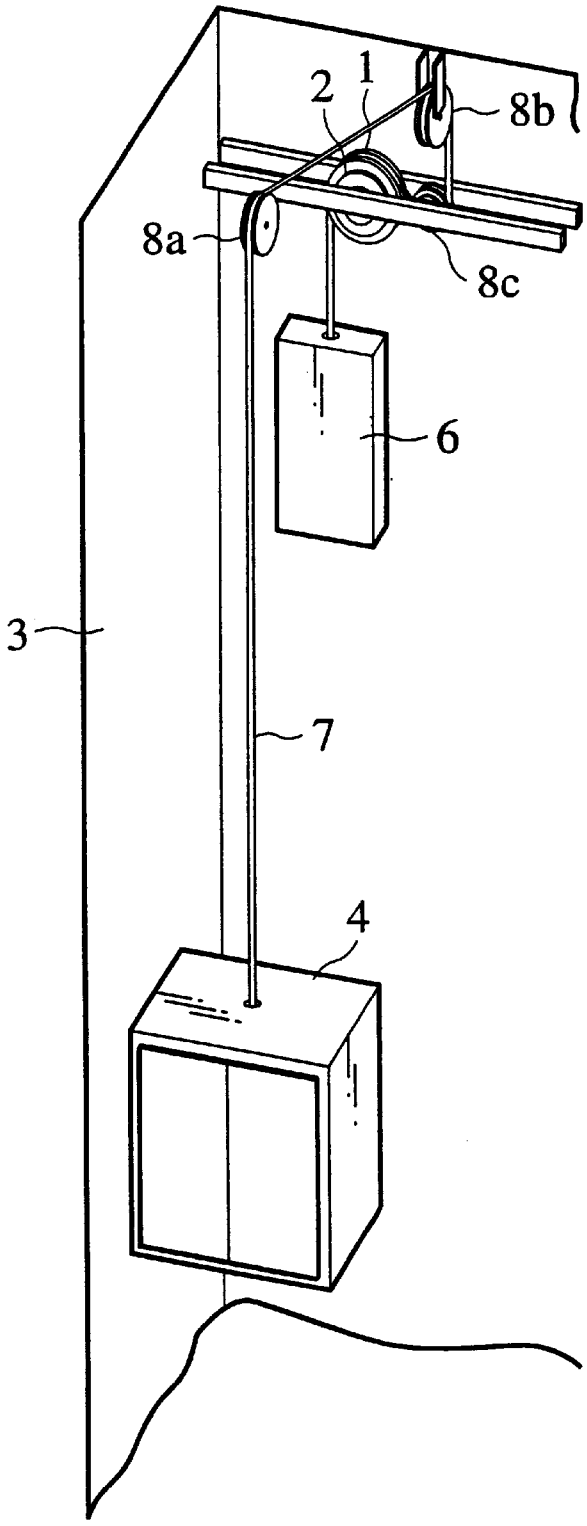
FIG.2 PRIOR ART
FIG. 2 is a perspective view of another conventional elevator apparatus showing an essential part thereof.

Note, throughout the first group of embodiments, elements similar to those of the aforementioned conventional elevator apparatus of FIGS. 1 and 2 are respectively indicated with the same reference numerals and additionally, the detailed descriptions of the similar elements are eliminated.

1st. Embodiment

Figure 3:
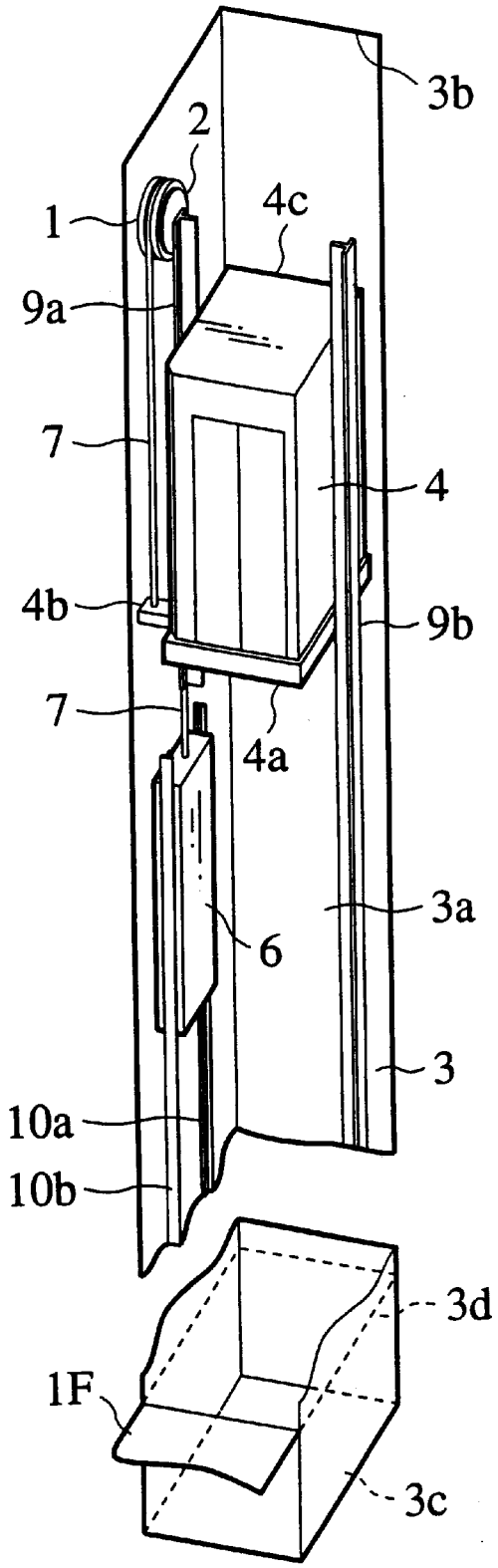
FIG. 3 is a perspective view of the elevator apparatus in accordance with the first embodiment of the invention, showing an essential part thereof.
Figure 4:
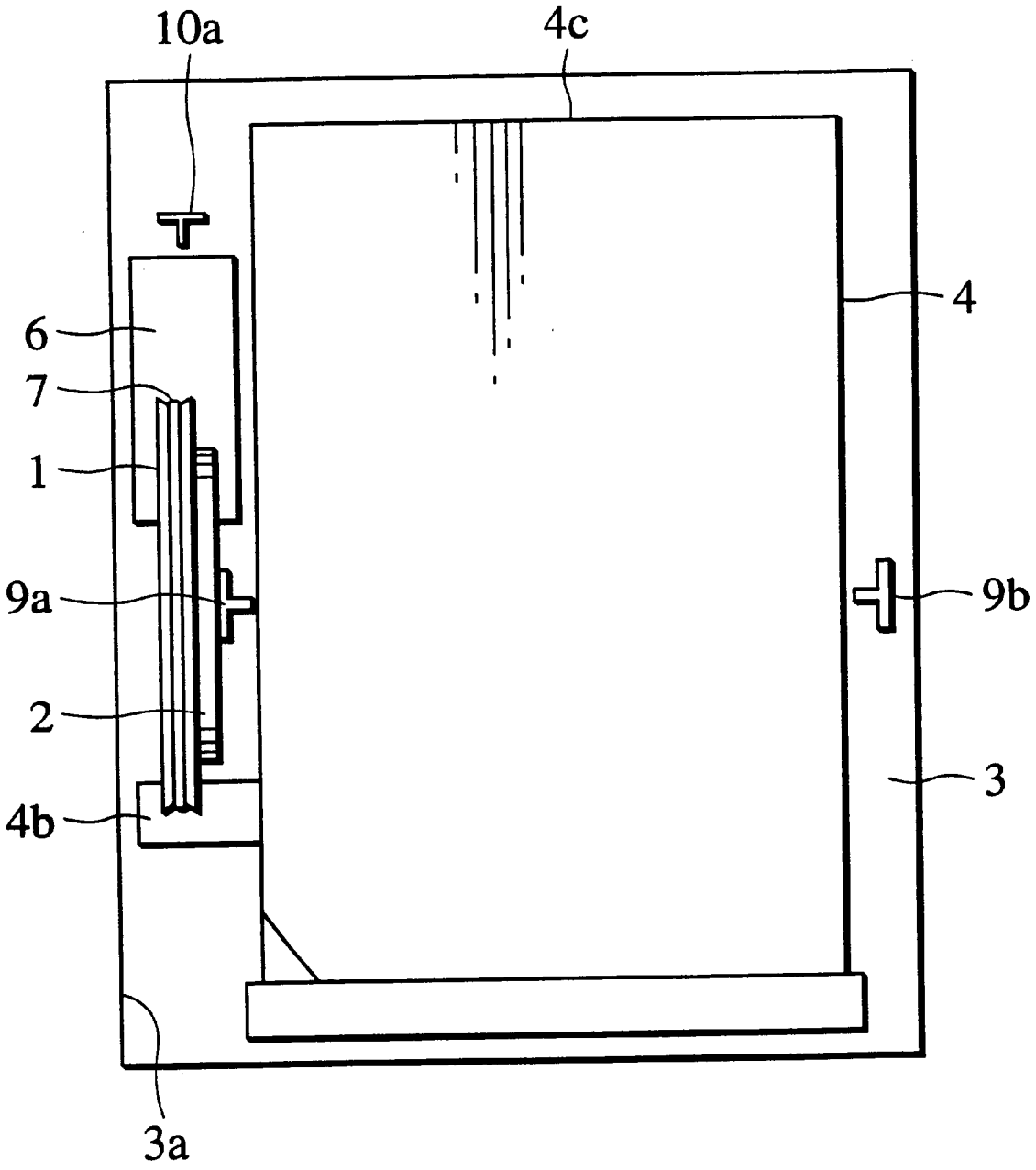
FIG. 4 is a plan view of the elevator apparatus of FIG. 3.

FIG. 3 is a perspective view of an elevator apparatus in accordance with the first embodiment of the present invention and FIG. 4 is an enlarged plan view of the elevator apparatus of FIG. 3.

According to the embodiment, a pair of elevator guide rails 9*a*, 9*b* each having a T-shaped cross section are attached to the side walls 3*a* defining the elevator path 3 through not-shown brackets . On the left side of the floor 4*a* of the elevator car 4, a hitch part 4*b* is formed so as to laterally project at a position below the roof 4*c* of the car 4. The hitch part 4*b* is connected to one end of the suspension rope 7 through a not-shown hitch spring.

The "flat and thin" type of driving mechanism 2 is secured on the top of the guide rail 9*a* and provided with the traction sheave 1. In plan view of FIG. 4, the traction sheave 1 is accommodated in a clearance defined between the side wall 3*a* of the elevator path 3 and a space occupied by the elevator car 4 traveling up and down in the elevator path 3. The suspension rope 7 is wound round the traction sheave 1. Adjacent to the elevator guide rail 9*a* for the elevator car 4, a pair of weight guide rails 10*a*, 10*b* are arranged for guidance of the movement of the balance weight 6. The other end of the suspension rope 7 is connected to the upper end of the balance weight 6.

In the above-constructed elevator apparatus, owing to the rotational operation of the traction sheave 1 associated with the driving mechanism 2, both elevator car 4 and balance weight 6, which are coupled to the respective ends of the suspension rope 7, are moved up and down under the guidance of the guide rails 9*a*, 9*b* and 10*a*, 10*b*, respectively.

As to this movement, when the elevator car 4 is elevated, then the car roof 4*c* is capable of rising in excess of the height of the driving mechanism 2 owing to the arrangement where the elevator car 4 is connected to the suspension rope 7 at the hitch part 4*b* below the car roof 4*c*.

Thus, as mentioned above, since the elevator apparatus of the first embodiment is constructed with the roping ratio of 1:1, both elevator car 4 and suspension rope 7 are driven at the same velocity thereby to realize the high-speed operation. Additionally, since the driving unit consisting of the traction sheave 1 and the driving mechanism 2 are accommodated in the clearance defined between the side wall 3*a* of the elevator path 3 and the space being occupied by the car 4 in the process of moving upward and downward, the car 4 can rise to the vicinity of the ceiling of the elevator path 3, so that it is possible to hold the height of the elevator path 3 to a minimum, thereby accomplishing the space-saving of the apparatus.

2nd. Embodiment

Now, although the driving unit is constituted by the single driving mechanism 2 in the first embodiment, it may be constituted by two or more mechanisms in order to not only realize the high-speed elevator apparatus but large-capacity, in the modification.

Figure 5:
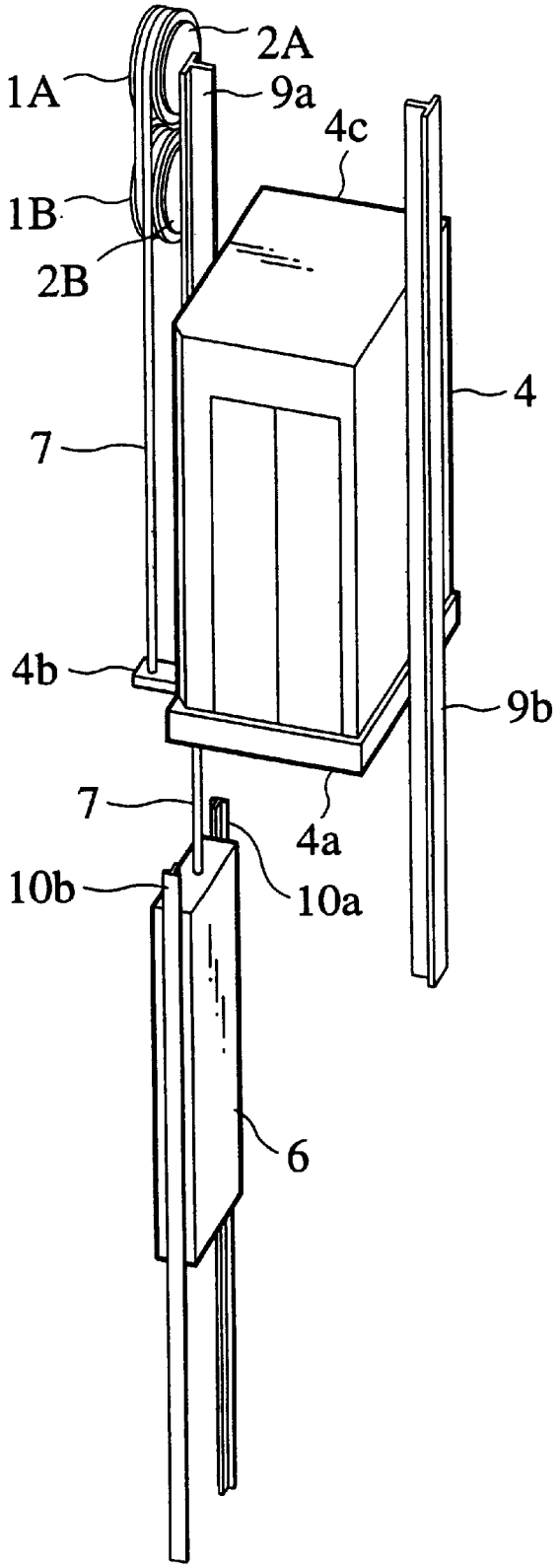
FIG. 5 is a perspective view of the elevator apparatus in accordance with the second embodiment of the invention, showing an essential part thereof.
Figure 6:
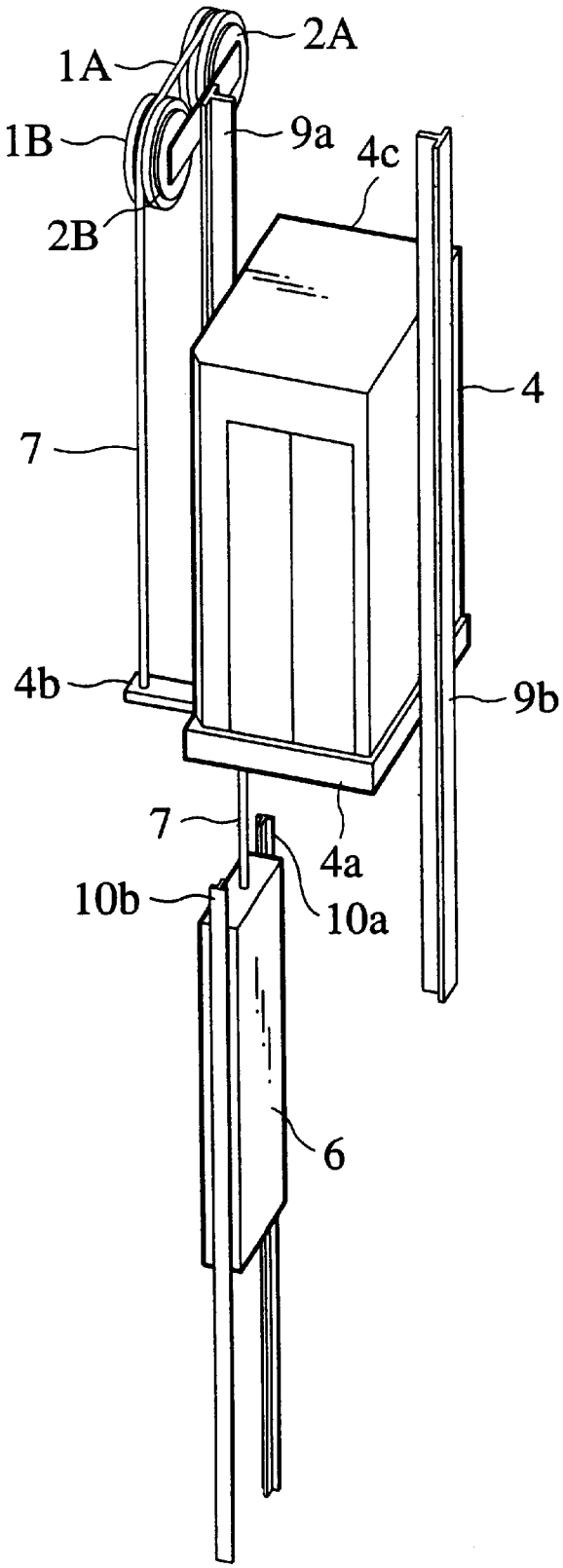
FIG. 6 is a perspective view of an essential part of the elevator apparatus provided with a different driving unit in the modification of FIG. 5.

From this point of view, we now describe the second embodiment where the driving unit is constituted by a plurality of driving mechanisms thereby realizing both high-speed and large-capacity elevator apparatus, with reference to FIGS. 5 and 6.

In the elevator apparatus of the second embodiment, as shown in FIG. 3 or FIG. 4, the flat and thin driving unit at the top of the rail 9*a* of T-shaped cross section is constituted by driving mechanisms 2A, 2B which are arranged in either vertical (FIG. 5) or horizontal (FIG. 6) direction of the apparatus, for driving traction sheaves 1A, 1B, respectively.

In FIG. 5, the suspension rope 7 having one end connected to the lower balance weight 6 is wound around the upper half periphery of the upper traction sheave 1A and the sequent lower half periphery of the lower traction sheave 1B. Thereafter, through the upper half periphery of the upper traction sheave 1A again, the rope 7 is hung downwardly and finally connected to the hitch part 4*b* on the underside of the elevator car 4. According to this arrangement, with the requirement of twice windings on the upper traction sheave 1A, a groove width of the sheave 1A is twice as large as the groove width of the lower traction sheave 1B. Furthermore, the suspension rope 7 is twice wound around the upper half periphery of the upper traction sheave 1A in FIG. 5. Therefore, it means that the suspension rope 7 is connected to the balance weight 6 and the elevator car 4 through the winding of three quarters on the upper and lower sheaves 1A, 1B in total after all. The same thing can be said of the arrangement shown in FIG. 6.

Thus, according to the second embodiment, the elevator car 4 can be moved at high speed equal to that of the rope 7 and the elevator car 4 can be large-sized with the increased thrust by the traction sheaves 1A, 1B.

Note, in case of the arrangement shown in FIG. 6 where the traction sheaves 1A, 1B are juxtaposed horizontally, it has the advantage of larger traction performance owing to the increased winding angles of the traction sheaves 1A, 1B to each other, especially.

3rd. Embodiment

Although the guide rails 9*a*, 9*b* are formed to have T-shaped cross sections in both first and second embodiments, the guide rail 9*a* on one hand may be formed to have a H-shaped cross section in order to improve its rigidity in the modification. Then, it will be expected to provide the elevator apparatus capable of traveling more stable.

Figure 7:
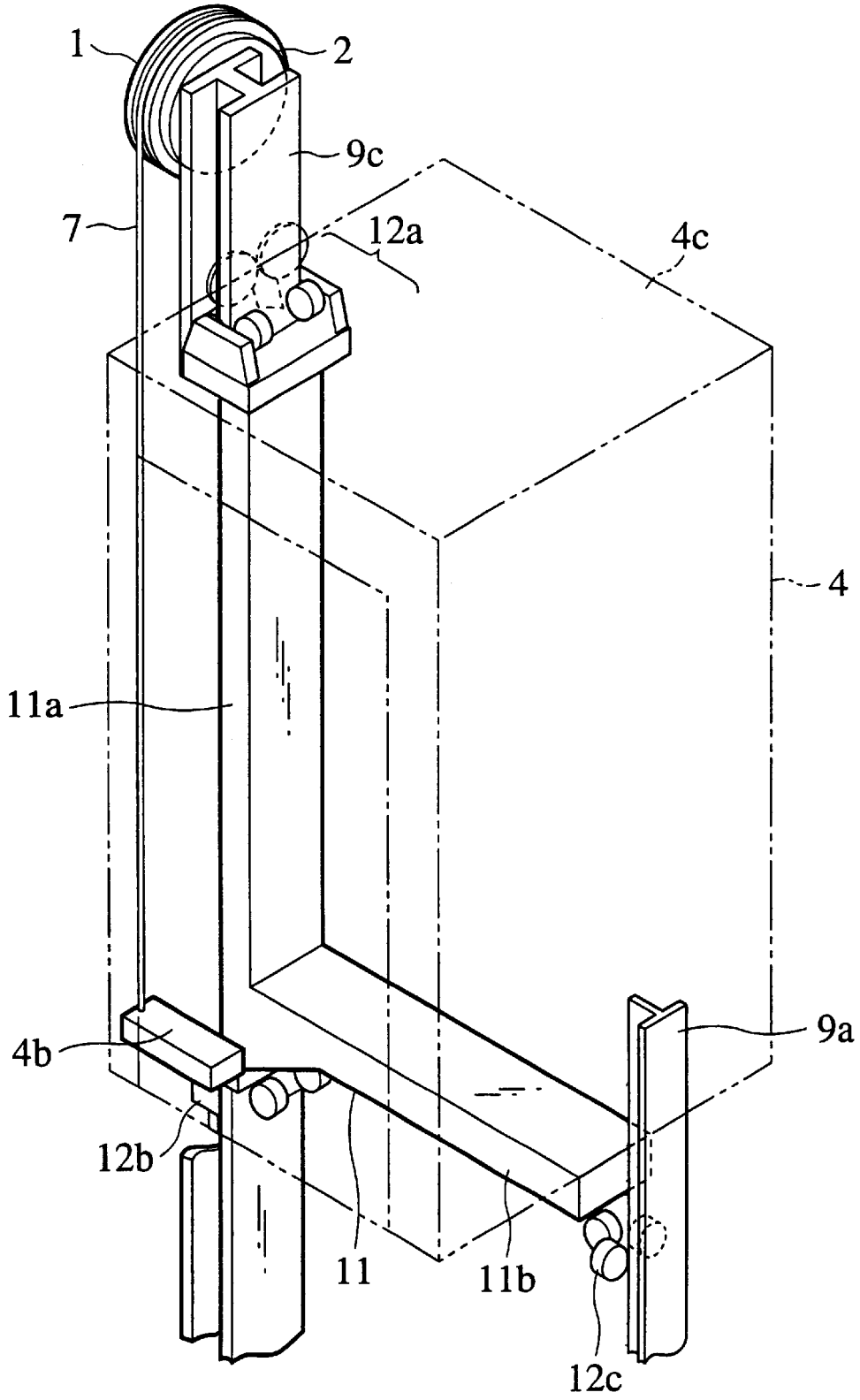
FIG. 7 is a perspective view of an essential part of the elevator apparatus in accordance with the third embodiment of the invention.
Figure 8:
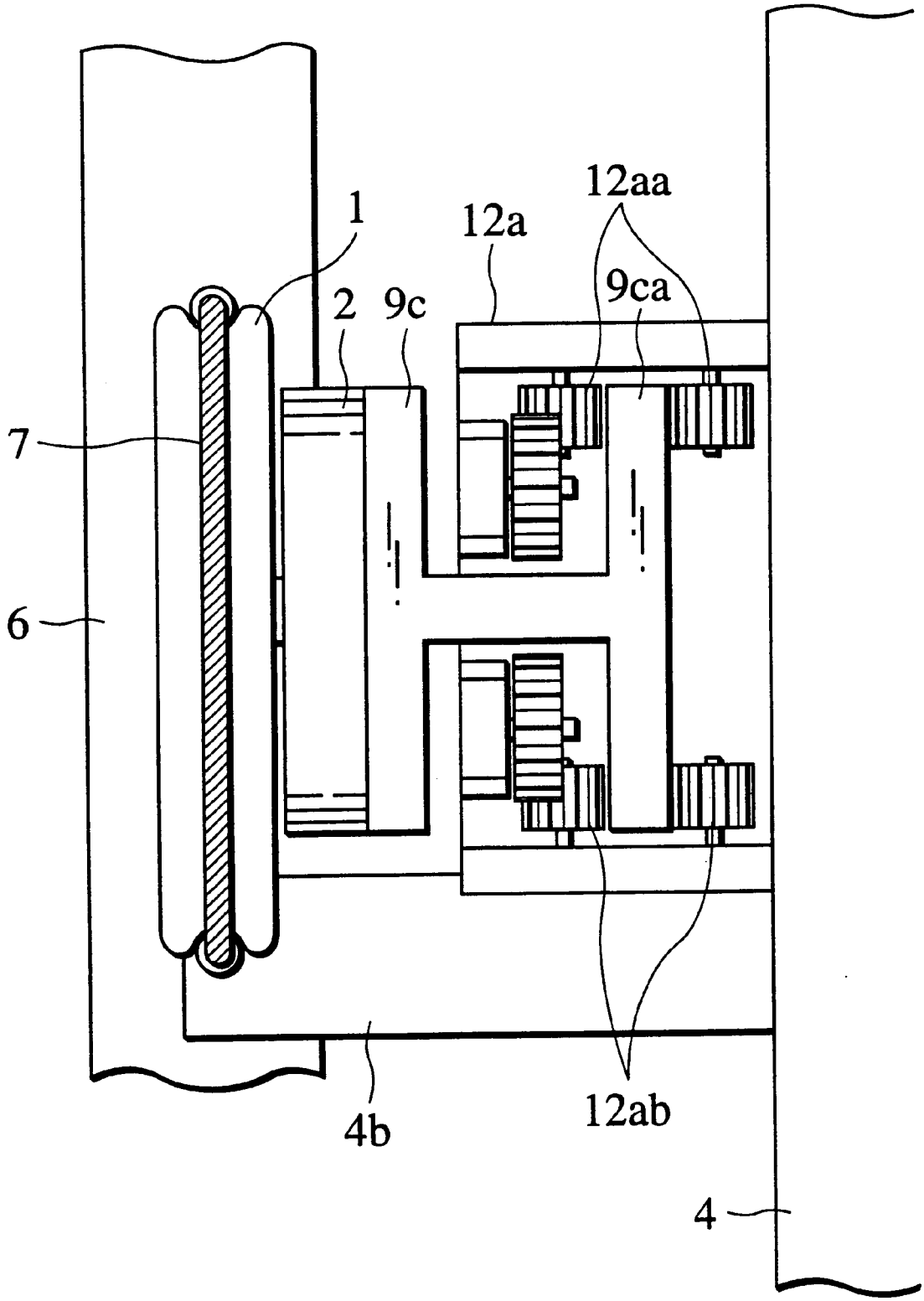
FIG. 8 is a plan view of the elevator apparatus of FIG. 7.

Thus, we now describe the elevator apparatus including one guide rail of the H-shaped cross section in accordance with the third embodiment of the invention, with reference to FIGS. 7 and 8.

According to the embodiment shown in FIG. 7, one of the guide rails 9*a* and 9*c*, i.e. the guide rail 9*c* is formed to have a H-shaped cross section, which is largely shown in FIG. 8, too. The guide rail 9*c* is fixed on the side wall 3*a* of the elevator path 3 by a not-shown bracket in a manner that parallel sides of the rail 9*c* oppose the elevator car 4.

The flat and thin driving mechanism 2 having the traction sheave 1 is arranged on the top of the guide rail 9*c* and accommodated in the clearance defined between the side wall 3*a* of the elevator path 3 and the occupied space by the car 4 in the process of moving upward and downward.

Additionally, a L-shaped frame 11 is provided for carrying and supporting the car 4 at the center of gravity. The frame 11 is composed of a vertical beam 11*a* and a horizontal beam 11*b*. Respectively attached on the upper and lower sides of the vertical beam 11*a* are upper and lower guide roller assemblies 12*a*, 12*b* each of which has a plurality of rollers 12*aa*, 12*ab* guiding one (9*ca*) of parallel side portions of the guide rail 9*c*. As largely shown in FIG. 8, at each of the guide roller assemblies 12*a*, 12*b*, the side portion 9*ca* close to the elevator car 4 is interposed between the roller 12*aa* and the accompanying roller 12*aa* and also interposed between the roller 12*ab* and the accompanying roller 12*ab*, on both sides of the portion 9*ca*.

Also, the horizontal beam 11*b* of the frame 11 is provided, at a tip thereof, with a roller assembly 12*c* which guides the movement of the elevator car 4 along the T-shaped cross-sectional guide rail 9*a*, as similar to the aforementioned embodiments.

Although the guide rails 10*a*, 10*b* for the balance weight 6 are not shown in FIGS. 7 and 8, the rails 10*a*, 10*b* are disposed adjacent to the guide rail 9*c* for the elevator car 4. Similarly, the suspension rope 7 having one end coupled to the top of the balance weight 6 and the other end coupled to the hitch part 4*b* below the L-shaped frame 11, is wound about the traction sheave 1.

In the above-constructed arrangement of the third embodiment, the elevator car 4 is guided by the upper and lower roller assemblies 12*a*, 12*b* while being supported by the vertical beam 11*a*. Then, the elevator's rolling about the longitudinal axis of the guide rail 9*c* can be restricted by the rollers 12*aa*, 12*ab* urging the side portion 9*ca* from the inside and outside.

Additionally, as to the elevator's pitching, the elevator car 4 can be restricted from being swung back and forth owing to the guidance of the guide roller assembly 12*c* at the tip of the horizontal beam 11*b* while interposing the guide rail 9*a*, so that the stable rise and fall can be accomplished.

In this way, according to the third embodiment, it is possible to provide the space-saving and high-speed elevator apparatus without forming the exclusive machine room on the roof of the building, as similar to the first and second embodiments. Additionally, owing to the adoption of the guide rail 9*c* of H-shaped cross section exhibiting a high rigidity, it is possible to realize the stable rise and fall of the elevator car 4.

Moreover, owing to the transverse beam 11*b* of the frame 11, the elevator car 4 can be carried with the simple structure, lightly and persistently.

4th. Embodiment

Although the car 4 is connected to the balance weight 6 through the single suspension rope 7 in common with the first, second and third embodiments, the single rope may be replaced with two or more suspension ropes 7 in view of the more stable and high-speed traveling of the car 4.

Figure 9:
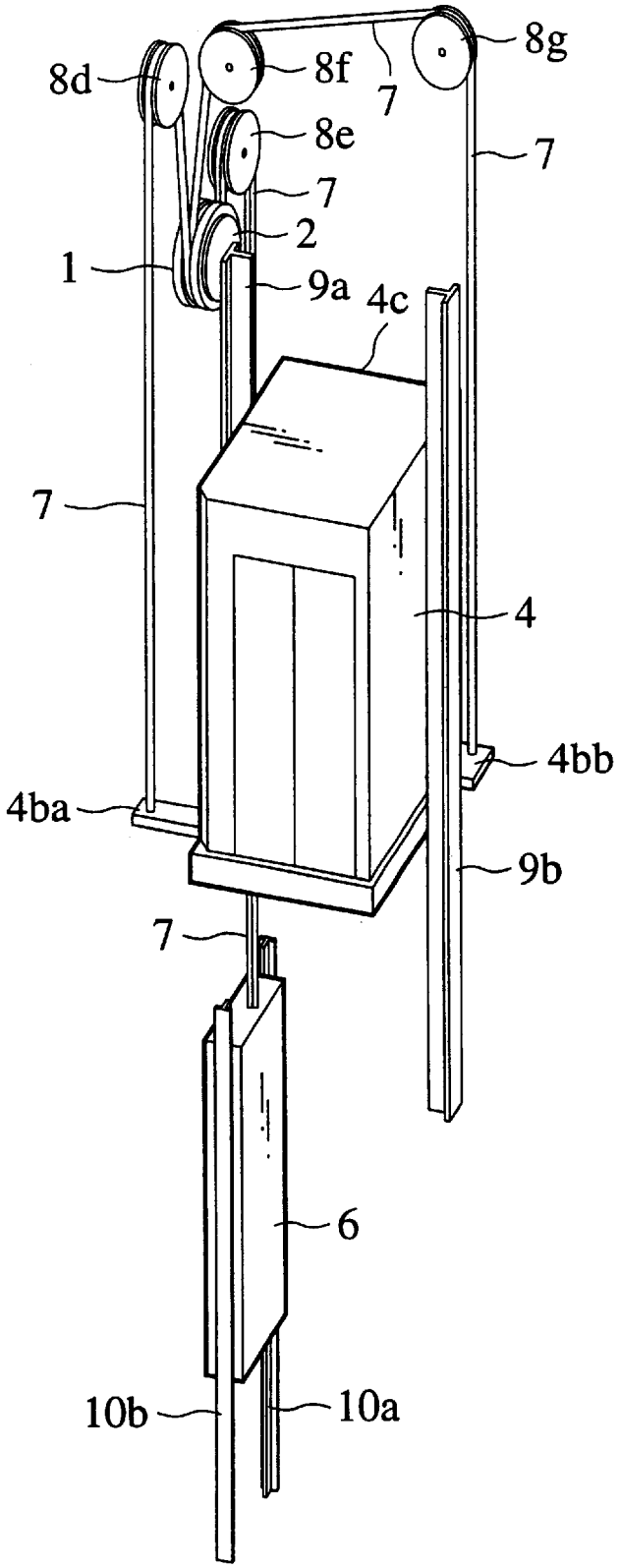
FIG. 9 is a perspective view of an essential part of the elevator apparatus in accordance with the fourth embodiment of the invention.
Figure 10:
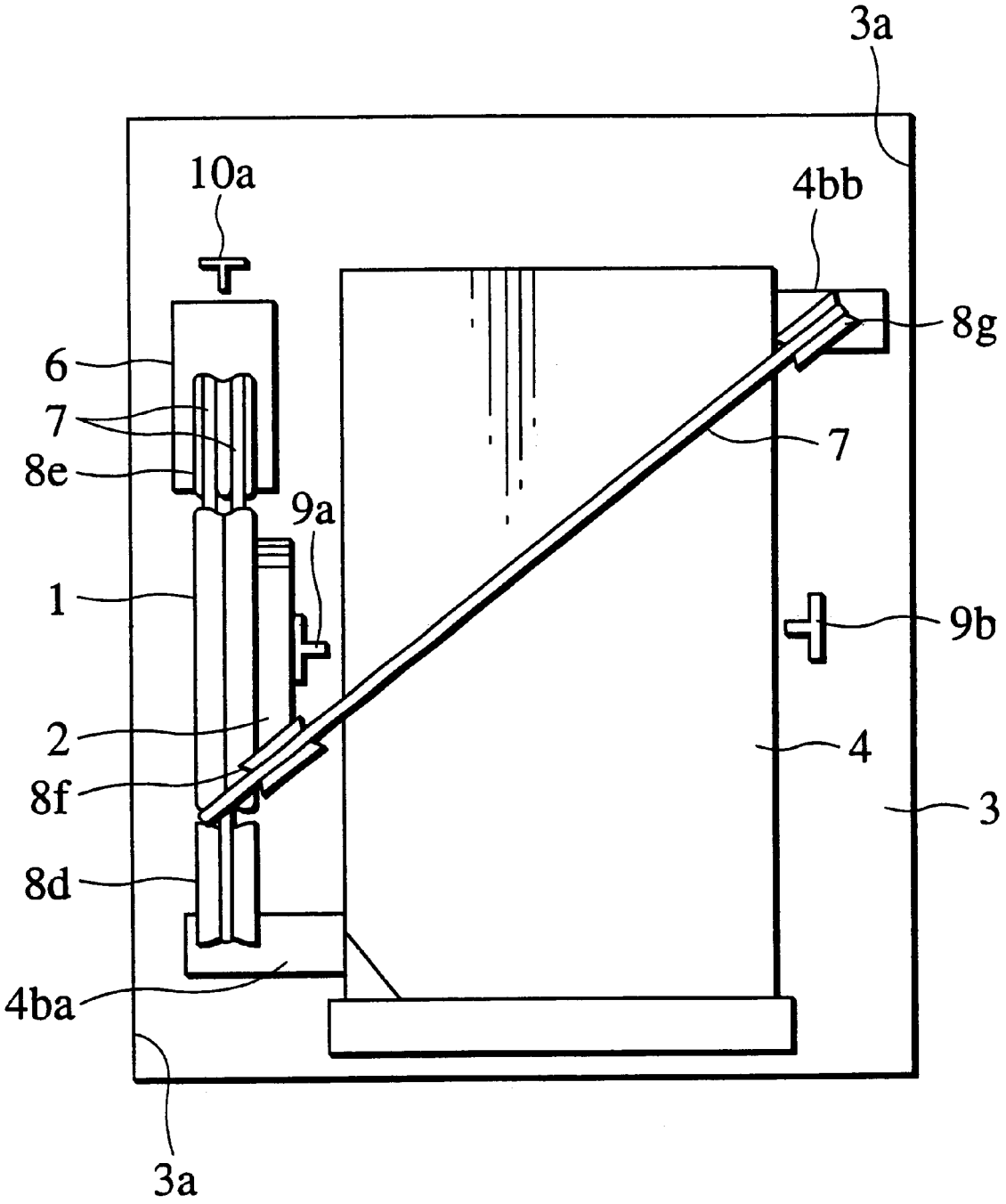
FIG. 10 is a plan view of the elevator apparatus of FIG. 9.

In this point of view, we now describe the fourth embodiment where the car 4 is associated with the balance weight 6 through the intermediary of two (plural) suspension ropes 7, with reference to FIGS. 9 and 10.

That is, in FIGS. 9 and 10, the flat and thin driving mechanism 2 coupled to the traction sheave 1 is attached to either one of the guide rails 9*a*, 9*b* for guiding the elevator car 4 and accommodated in the space between the car 4 and the side wall 3*a* of the elevator path 3, as similar to the first to third embodiments.

Thus, at the top of the guide rail 9*a*, two sheaves 8*d*, 8*e* are arranged in parallel with both sides of the elevator car 4. Additionally, in position of the elevator path 3 besides the occupied space by the car 4 in the process of moving upward and downward, one sheave 8*f* is arranged so as to cross the sheaves 8*d*, 8*e* at an angle of 45 degrees.

On the lower side of the car 4, pitch parts 4*ba*, 4*bb* for connection with the suspension rope 7 are arranged symmetrically with each other about the gravity center of the elevator car 4. Further, the sheaves 8*d*, 8*g* corresponding to the hitch parts 4*ba*, 4*bb* are attached on the side walls 3*a* defining the elevator path 3 so as not to interfere with the occupied space by the car 4 in the process of moving upward and downward.

Therefore, two suspension ropes 7 each having one end coupled to the balance weight 6 are wound round the traction sheave 1 through the sheave 8*e* attached to the top wall 3*b* above the weight 6 and thereafter, divided into different directions, i.e. two courses.

Either of the so-divided suspension ropes 7 has one end connected with the elevator car 4 at the hitch part 4*ba* through the intermediary of the sheave 8*d* attached on the wall 3*a*. While, another suspension rope 7 has one end connected with the elevator car 4 at the hitch part 4*bb* through the intermediary of the sheave 8*f* attached on the side wall 3*a* at an angle of approx. 45 degrees and the sequent sheave 8 g also attached on the right side wall 3*a* at an angle of approx. 45 degrees.

In the above-constructed fourth embodiment, owing to the drive of the driving mechanism 2, the suspension ropes 7 divided into two routes operate to rise and fall the elevator car 4 via the sheaves 8*d*, 8*f*, 8*g* on one hand and the balance weight 6 via the sheave 8*e* on the other hand.

Thus, according to the fourth embodiment, the elevator car 4 can rise and fall at high speed equal to that of the suspension rope 7 due to the roping ratio of 1:1. Furthermore, since both sides of the elevator car 4 in the diagonal direction are being suspended by the suspension ropes 7 of two routes during the traveling, the car's posture can be stabilized. Again, owing to the arrangement where the driving unit and the respective sheaves 8*d*, 8*e*, 8*f*, 8*g* are arranged so as not to interfere with the occupied space by the car 4 in the process of moving upward and downward, it is possible to elevate the elevator car 4 so that the roof 4*c* reaches the vicinity of the roof wall of the elevator path 3, whereby the elevator apparatus including the elevator path 3 can be small-sized with the improvement of efficiency in using the elevator path 3.

5th. Embodiment

Now, it is expected that the elevator car's capacity would be increased when the hanging positions on both sides of the elevator car 4 are arranged so as to be symmetrical with each other about the gravity center of the car 4 and the elevator apparatus is provided, on left and right sides thereof, with the driving units as shown in FIG. 3.

Figure 11:
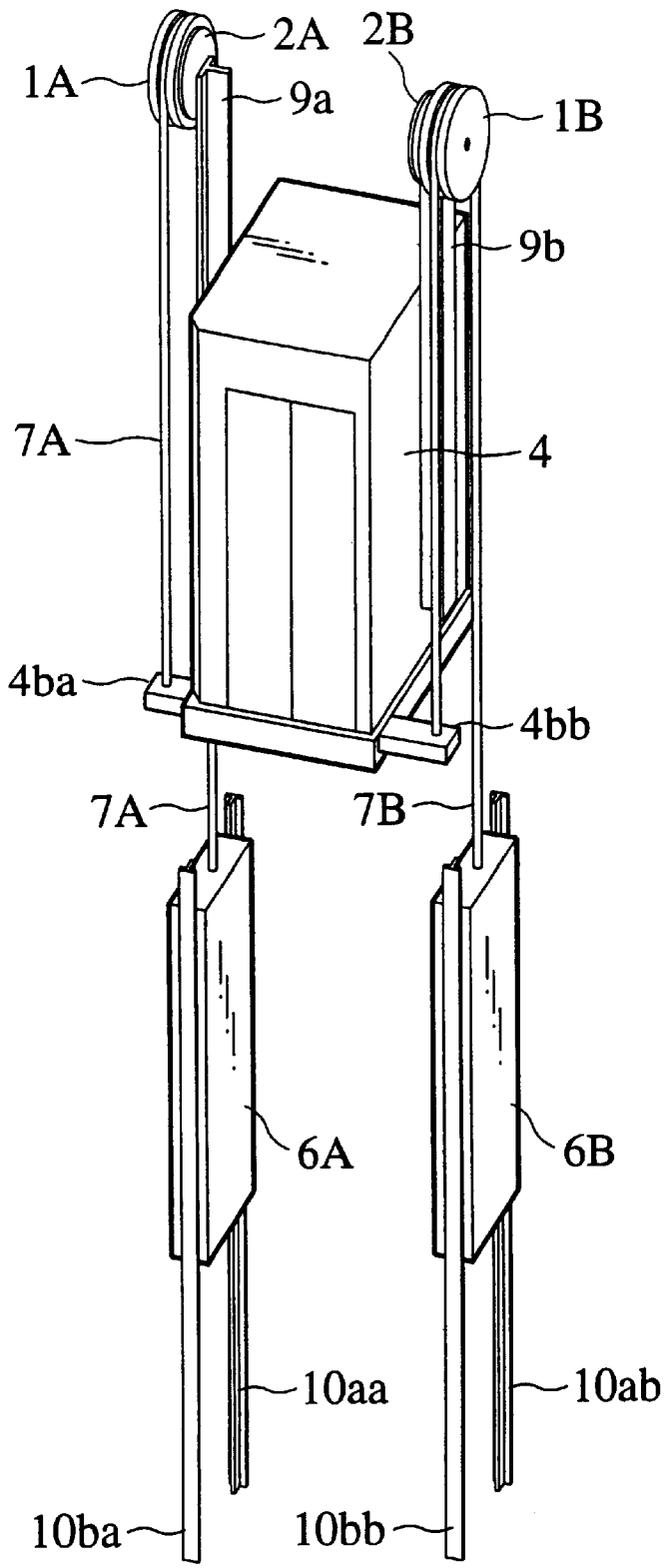
FIG. 11 is a perspective view of an essential part of the elevator apparatus in accordance with the fifth embodiment of the invention.
Figure 12:
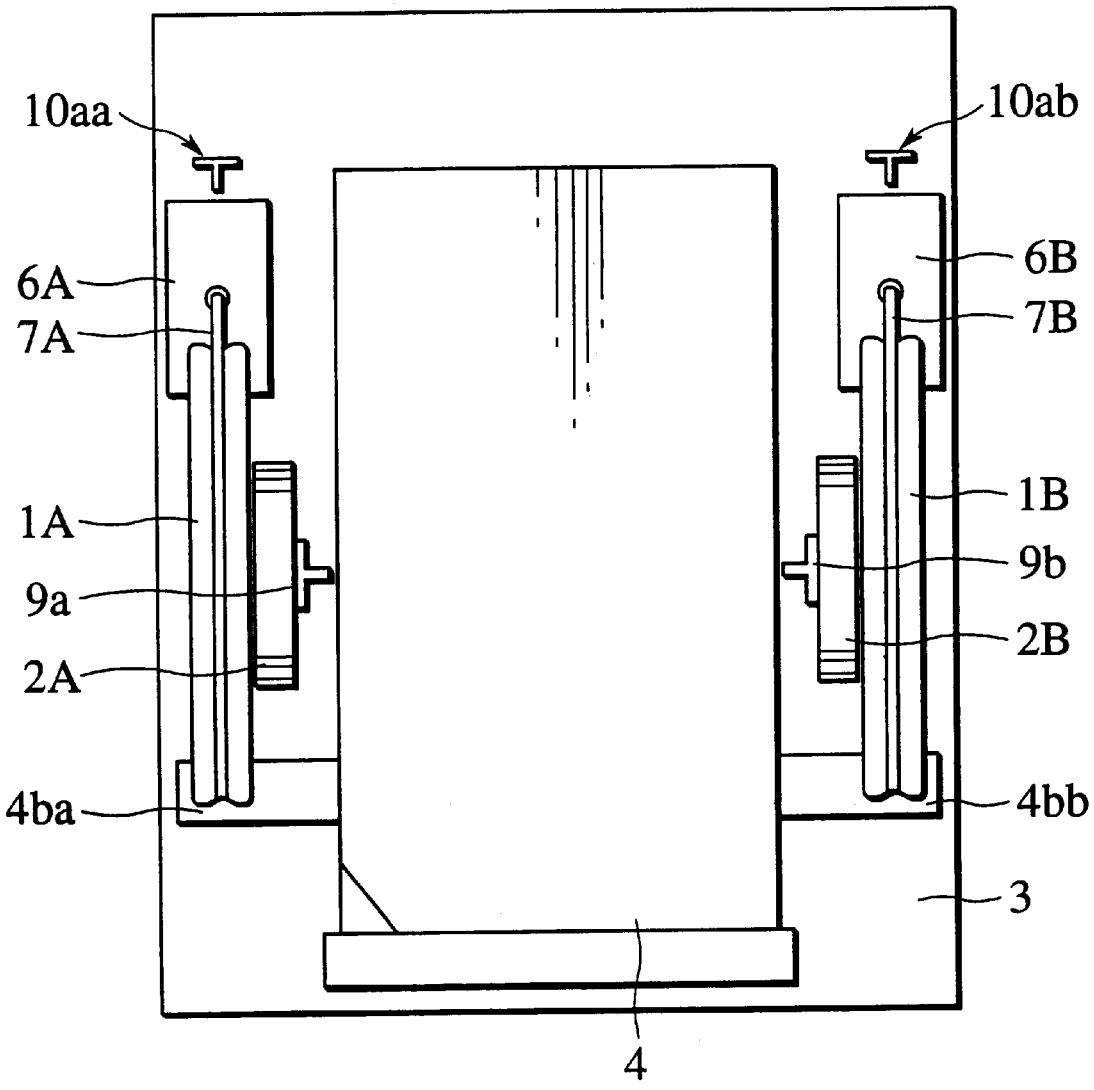
FIG. 12 is a plan view of the elevator apparatus of FIG. 11.

We now describe the large-capacity elevator apparatus with a pair of driving units in accordance with the fifth embodiment, with reference to FIGS. 11 and 12.

According to the embodiment, there are provided a pair of driving mechanisms 2A, 2B connected to traction sheaves 1A, 1B, in the vicinity of the respective tops of the guide rails 9*a*, 9*b* for guiding the car 4, respectively. Guide rails 10*aa*, 10*ba* for a balance weight 6A are arranged adjacent to the guide rail 9*a*. Similarly, guide rails 10*ab*, 10*bb* for another balance weight 6B are arranged adjacent to the guide rail 9*b*. On the left and right sides of the elevator car 4, hitch parts 4*ba*, 4*bb* are attached to the car 4, symmetrically with each other. Suspension ropes 7A, 7B having respective ends coupled to the hitch parts 4*ba*, 4*bb* are wound round the traction sheaves 1A, 1B and finally connected to the balance weights 6A, 6B, respectively.

In this embodiment, the driving mechanisms 2A, 2B on both sides of the car 4 are driven by the single control device, for the requirement of synchronous operation. The elevator car 4 is driven to rise and fall by the driving mechanisms 2A, 2B, so that a large thrust force is provided against the car 4. Furthermore, owing to the roping ratio of 1:1 by the suspension ropes 7A, 7B, the moving velocity of the car 4 becomes to be equal to that of each suspension rope 7A, 7B moving at high speed.

Also in this embodiment, since the driving mechanisms 2A, 2B are arranged so as not to interfere with the occupied space by the car 4 in the process of moving upward and downward, it is possible to reduce the height of the elevator path 3 without providing the exclusive machine room on the roof top etc. The respective positions of the suspension ropes 7A, 7B are established in symmetry with each other about the gravity center of the car 4, the moving car's posture can be stabilized, too.

6th. Embodiment

Although the balance weights 6A, 6B are disposed on the left and right sides of the car 4 in the above-mentioned fifth embodiment, they may be replaced with the common balance weight in order to realize the apparatus of simple structure.

Figure 13:
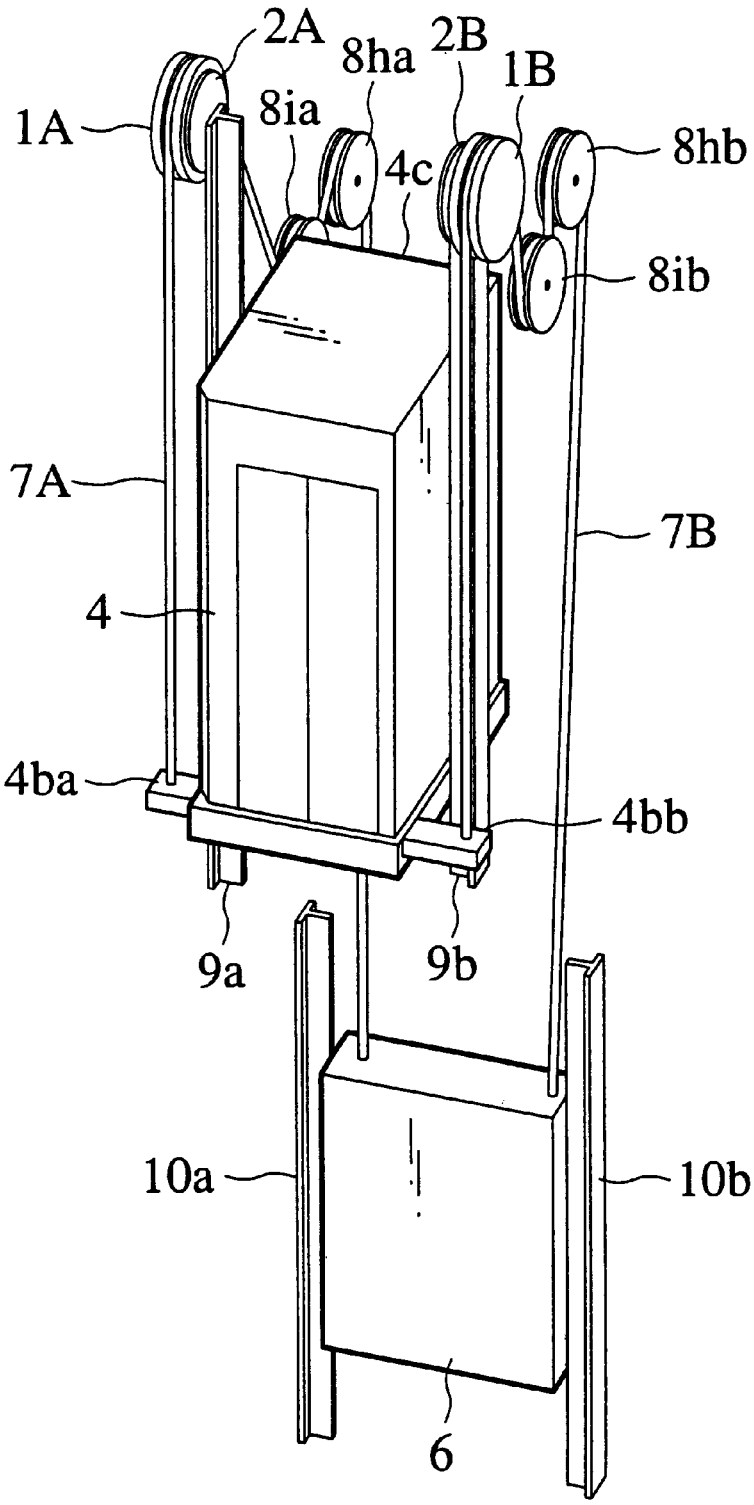
FIG. 13 is a perspective view of an essential part of the elevator apparatus in accordance with the sixth embodiment of the invention.
Figure 14:
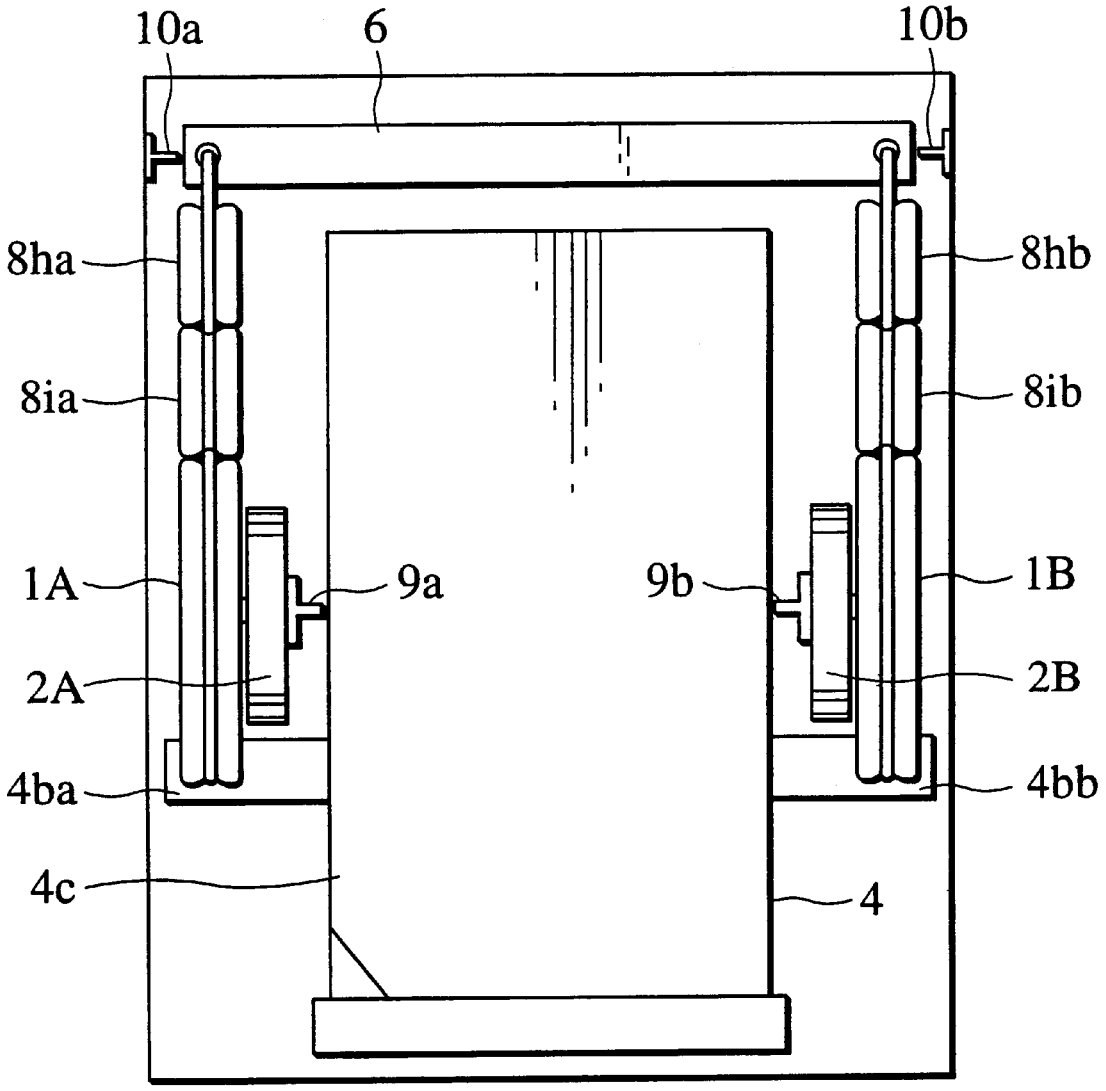
FIG. 14 is a plan view of the elevator apparatus of FIG. 13.

From this point of view, we now describe the sixth embodiment with reference to FIGS. 13 and 14.

According to the embodiment, there are provided the driving mechanisms 2A, 2B which have the traction sheaves 1A, 1B arranged in the vicinity of the guide rails 9*a*, 9*b*, respectively. In the rear part of the elevator path 3 between the guide rails 9*a* and 9*b*, the common balance weight 6 is adapted so as to rise and fall under the guidance of the rails 10*a*, 10*b*.

On the left and right sides of the car 4, the suspension ropes 7A, 7B respectively connected to the hitch parts 4*ba*, 4*bb* below the car roof 4*c* are wound round the traction sheaves 1A, 1B, respectively and the ropes 7A, 7B are coupled to the common balance weight 6 finally.

Also in this embodiment, the left and right driving mechanisms 2A, 2B are controlled by the single control unit, so that the elevator car 4 can rise and fall owing to the mechanisms' synchronous operation at the same speed. Again, the elevator car 4 does rise and fall at speed equal to those of the suspension ropes 7A, 7B owing to the thrust force by the driving mechanisms 2A, 2B. As similar to the first to fifth embodiments, since the driving unit and the sheaves 8*ha*, 6*hb*, 8*ia*, 8*ib* are arranged so as not to interfere with the occupied space by the car 4 in the process of moving upward and downward, it is possible to reduce the height of the elevator path 3 to a minimum.

It should be noted that, in common with the first to sixth embodiments of the invention, the driving unit is attached on either one of the top of the guide rail 9*a* and the wall of the elevator path 3 and also arranged so as not to interfere with the occupied space by the car 4 in the process of moving upward and downward. In the modification, the driving unit may be arranged in the elevator path 3 adjacent to the first floor, provided that the driving unit does not interfere with the occupied space by the car 4 in the process of moving upward and downward.

Note, in case of fixing the driving unit etc. on the guide rail, then the attachment and fixing work can be facilitated but applying loads on the guide rail. On the contrary, in case of attaching the driving unit on the wall of the elevator path 3, then the arrangement would have the advantage of applying no load on the guide rail.

Again, if the driving unit 2 is positioned in the vicinity of the first floor (1F) of the elevator path, it would be possible to reduce a height of the roof of the elevator path to a minimum, as similar to the above-mentioned embodiments. Additionally, because of the work for maintenance and inspection in the neighborhood of ground, it is possible to lighten the burden on the workers.

7th. Embodiment

Repeatedly, throughout the above-mentioned embodiments, the driving unit 2 is arranged in the upper part of the elevator path or the vicinity of the first floor so as not to interfere with the movement of the elevator car 4, thereby restricting to increase the height of elevator path. Similarly, even when the driving unit is disposed in a pit of the elevator path, the height of elevator path would be effectively utilized to reduce either height of the elevator path or height of the building.

Figure 15:
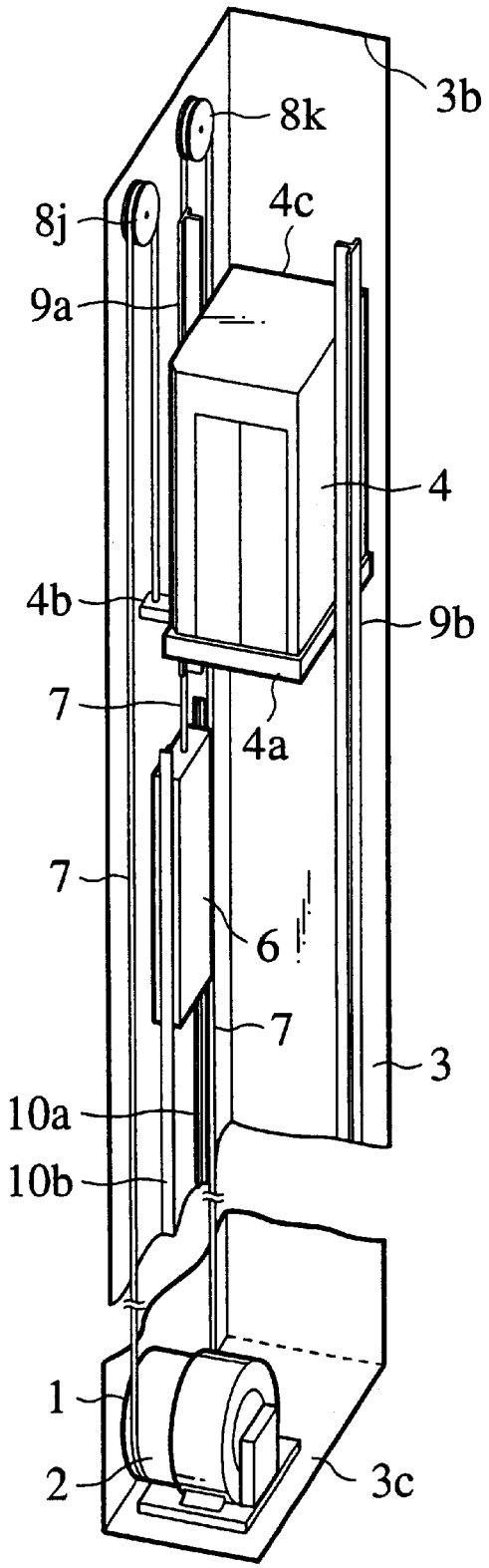
FIG. 15 is a perspective view of an essential part of the elevator apparatus in accordance with the seventh embodiment of the invention.

From the above point of view, we now describe the seventh embodiment where the driving unit 2 is disposed in the pit 3*c* of the elevator path 3, with reference to FIG. 15.

As shown in the figure, the driving unit consisting of the traction sheave and the driving mechanism 2 is arranged in the pit 3*c* of the elevator path 3. One end of the suspension rope 7 wound about the traction sheave 1 is connected to the hitch part 4*b* through a sheave 8*j* in the vicinity of the roof of the elevator path 3, while the other end of the rope 7 is connected to the balance weight 6 through a sheave 8*k* in the vicinity of the roof of the elevator path 3.

Accordingly, according to the embodiment, it is possible to make effective use of even the neighborhood of roof of the elevator path 3 in case of the elevation of the elevator car 4 and furthermore, the high-speed elevator can be provided due to the roping ratio of 1:1.

Note, although the shown embodiment does adopt the single driving mechanism 2, for example, it may be replaced with a pair of driving units in the pit 3*c* for realizing the large-capacity, as similar to the units shown in FIGS. 11 to 13.

8th. Embodiment

Figure 16:
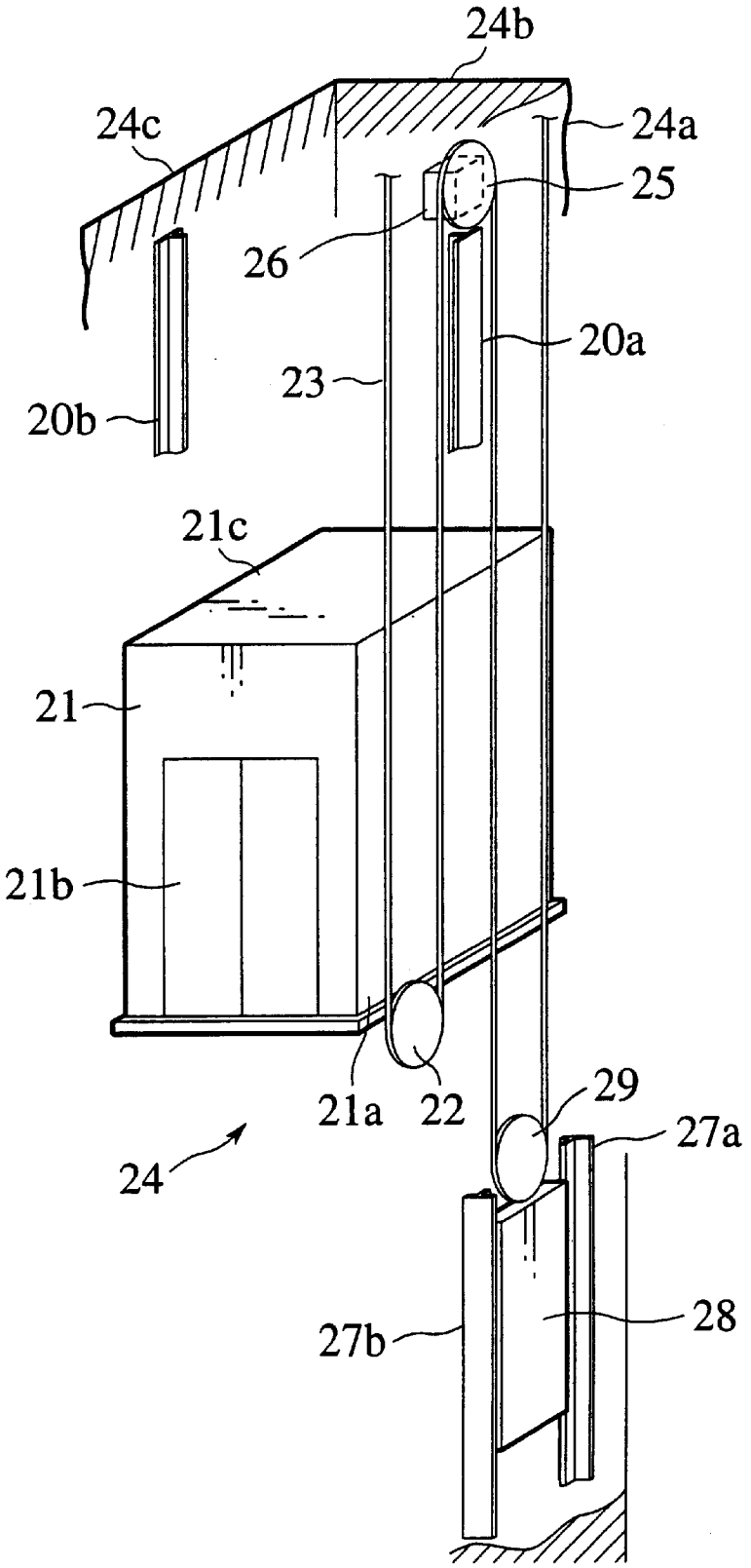
FIG. 16 is a perspective view of an essential part of the elevator apparatus in accordance with the eighth embodiment of the invention.
Figure 17:
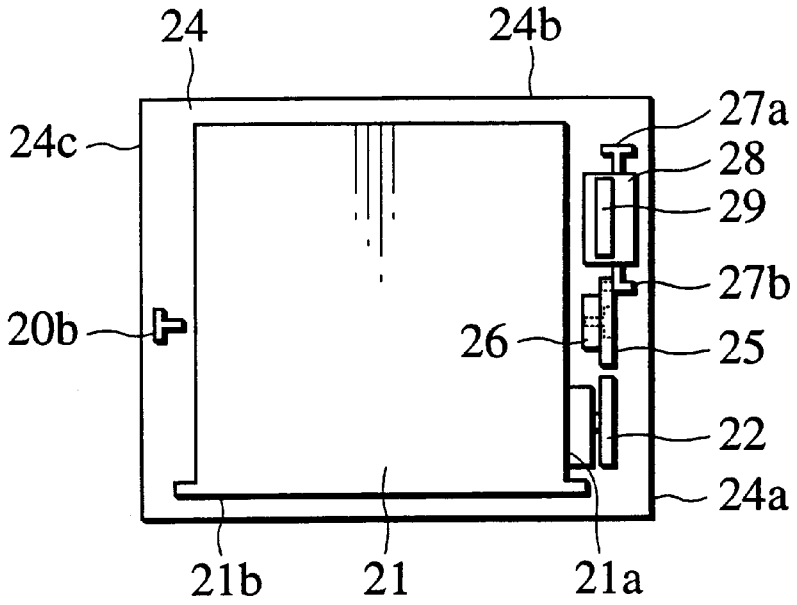
FIG. 17 is a plan view of the elevator apparatus of FIG. 16.

FIGS. 16 and 17 show the eighth embodiment of the invention. According to this embodiment, an elevator car 21 is guided by two parallel guide rails 20*a*, 20*b* mounted on side walls 24*a* of an elevator path (hoistway) 24 through not-shown brackets. A turning sheave 22 is attached on a side face 21*a* of the elevator car 21, namely, either one of the left and right faces on both sides of a front face 21*b* as the entrance for the elevator car 21 so that a rotational plane of the sheave 22 is parallel with the side face 21*a*. A suspension rope 23 is wound round the turning sheave 22, while the elevator car 21 is suspended by the suspension rope 23 through the turning sheave 22.

Fixed on the top of the guide rail 20*a* on the side of the turning sheave 22 is a driving unit 26 which drives to rotate a flat and thin traction sheave 25 disposed between the side wall 24*a* of the elevator path 24 and the space being occupied by the rising and falling elevator car 21. The suspension rope 23 is wound round the traction sheave 25 and also wound or rewound in a "well bucket" manner by the rotation of the traction sheave 25.

A pair of guide rails 27*a*, 27*b* for balance weight are arranged in a position adjacent to the guide rail 20*a*, for allowing a balance weight 28 to rise and fall under their guidance. Attached on the top of the balance weight 28 is a turning sheave 29 about which the suspension rope 23 is also wound to hang the weight 28. Both ends of the suspension rope 23 are connected to supporting members (not shown) and carried by the members, which are built in the ceiling of the elevator path 24 over the elevator car 21, through the intermediary of hitch springs also not shown in the figure.

The elevator apparatus of the first embodiment operates as follows. With the drive of the driving unit 26, the traction sheave 25 is rotated and therefore, the suspension rope 23 rolled thereon is wound up and rewound, so that the elevator car 21 and balance weight 28 rise and fall in opposite directions, under the guidance of the guide rails 20*a*, 20*b*; 27*a*, 27*b*, respectively. Then, since the elevator car 21 is suspended by the suspension rope 23 through the turning sheave 22 disposed on the side face 21*a* under a ceiling (roof) face 21*c*, the elevator car 21 can be elevated in a manner that the ceiling face 21*c* moves upward in excess of the driving unit 26 in the elevator path 24.

Thus, according to the embodiment, since the elevator car 21 hung by the suspension rope 23 performs an action like a moving pulley due to the turning sheave 22, it is possible to reduce the power capacity required for the driving unit 26 in comparison with that required for the driving unit 26 in direct-hanging the car 21 by the traction sheave 25. Repeatedly since the driving unit 26 is arranged in a space in the elevator path 24, between the side wall 24*a* of the elevator path 24 and the space being occupied by the rising and falling elevator car 21 and additionally, the elevator car 21 can rise and fall close to the ceiling and floor of the elevator path 24 without requiring any more space above or beneath the path 24, it is possible to establish a height of the path 24 to a minimum.

9th. Embodiment

Figure 19:
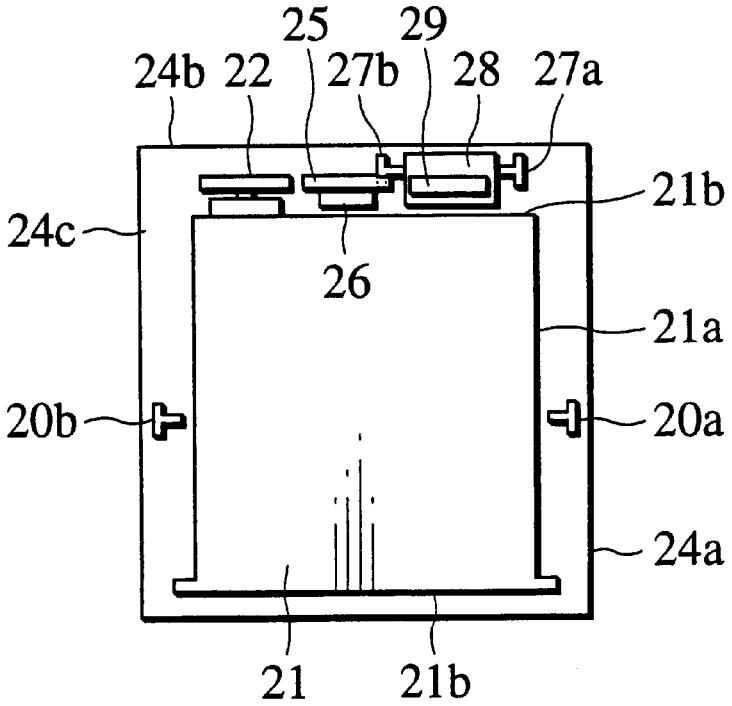
FIG. 19 is a plan view of the elevator apparatus of FIG. 18.
Figure 18:
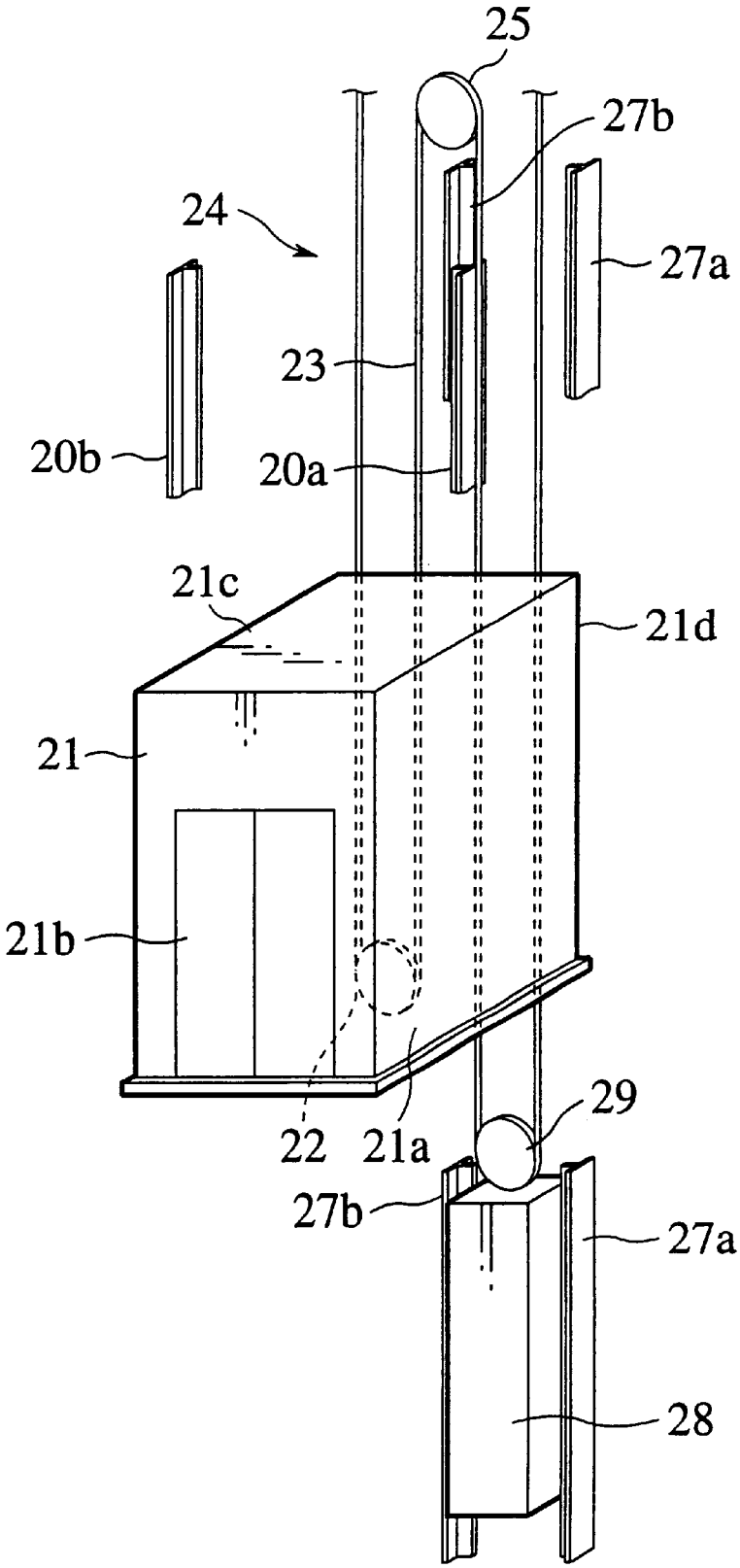
FIG. 18 is a perspective view of an essential part of the elevator apparatus in accordance with the ninth embodiment of the invention.

The ninth embodiment will be described below, with reference to FIGS. 18 and 19. The ninth embodiment is differentiated from the eighth embodiment in that a balance weight 28 is guided by the guide rails 27*a*, 27*b* provided on a back wall 24 of the elevator path 24, for the weight's free elevation and that the elevator car 21 is provided, on a back face 21*d* thereof, with the turning sheave 22. Further, the elevator apparatus in accordance with the ninth embodiment is characterized in that the flat and thin driving unit 26 is mounted on the guide rail 27*a* for the balance weight and the traction sheave 25 is positioned in the clearance between the back wall 24*b* of the elevator path 24 and the space being occupied by the moving elevator car 21. The other structure of the ninth embodiment is similar to that of the eighth embodiment of FIGS. 16 and 17 and therefore, the elements similar to those of the eighth embodiment are indicated with the same references, respectively.

Note, preferably, the elevator apparatus in accordance with the ninth embodiment is established in the elevator path 24 having a relatively large room.

10th. Embodiment

Figure 20:
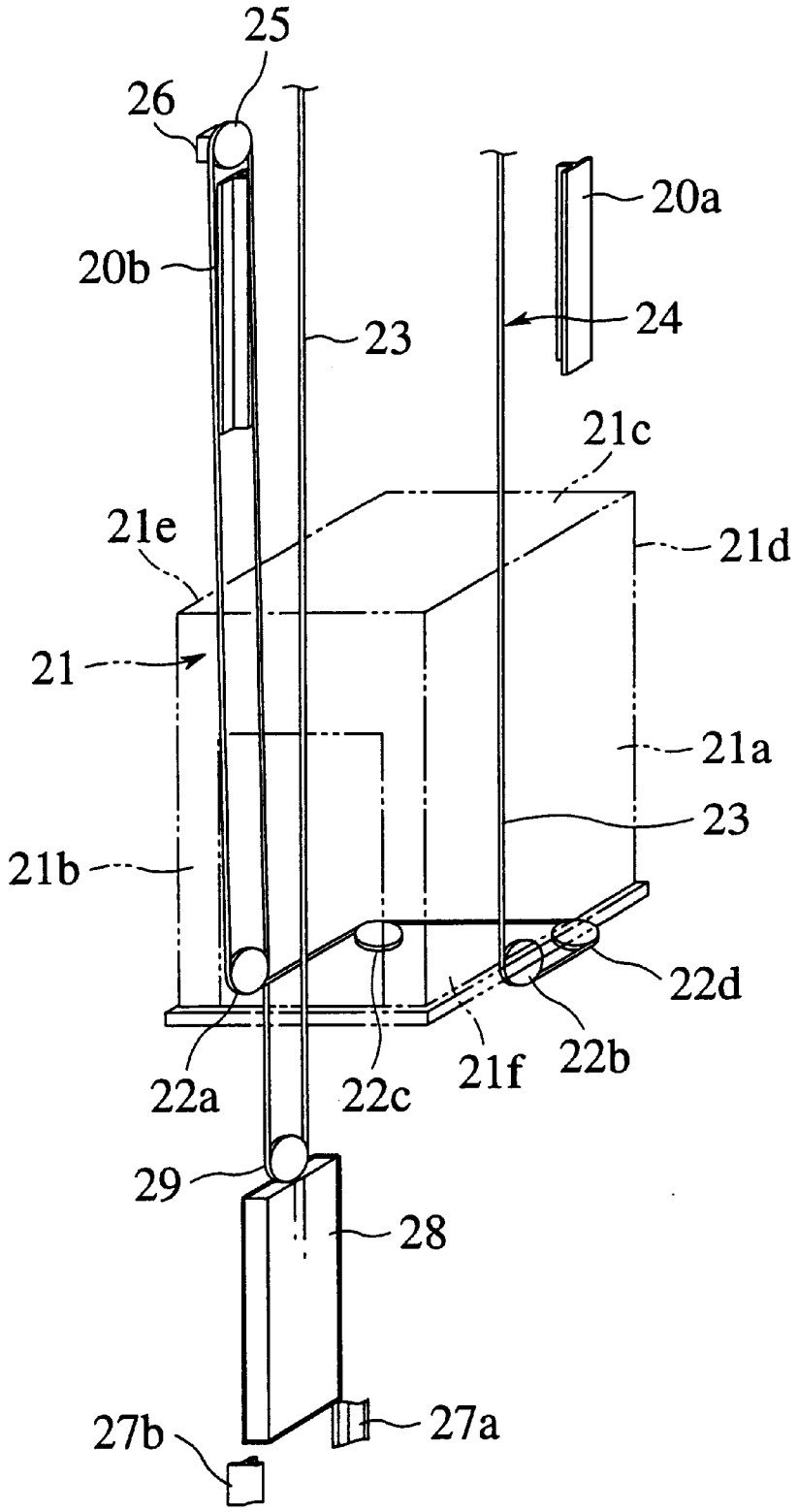
FIG. 20 is a perspective view of an essential part of the elevator apparatus in accordance with the tenth embodiment of the invention.

Referring to FIG. 20, we now describe the elevator apparatus in accordance with the tenth embodiment.

According to the embodiment, a pair of bilaterally symmetrical turning sheaves 22*a*, 22*b* are respectively attached on the side faces 21*a*, 21*e* of the elevator car 21, which is guided by the guide rails 20*a*, 20*b* secured on the side walls of the elevator path 24 through not-shown brackets, and furthermore, the elevator car 21 is provided, on the underside of a floor face 21*f*, with turning sheaves 22*c*, 22*d* having respective rotating planes parallel with the floor face 21*f*. The suspension rope 23 is wound round these turning sheaves 22*a* to 22*d*. Adjacent to the guide rail 20*b*, a pair of guide rails 27*a*, 27*b* are fixed on the side wall of the elevator path 24, for guiding the rise and fall of the balance weight 28. Note, the balance weight 28 is provided, at a top thereof, with a turning sheave 29.

In case of this embodiment, the driving unit 26 is mounted on the top of the guide rail 20*b*, while the traction sheave 25 is positioned in the clearance between the side wall of the elevator path 24 and the space being occupied by the moving elevator car 21.

In arrangement, the suspension rope 23 is wound round the traction sheave 25, the turning sheaves 22*a*, 22*b* on the side faces 21*a*, 21*e* of the car 21, the turning sheaves 22*c*, 22*d* on the bottom face and the turning sheave 29 for the balance weight 28 in order. While, both ends of the rope 23 are connected to the supporting members (not shown) on the ceiling above the elevator path 24 through the hitch springs (also not shown).

In the elevator apparatus of the embodiment, by driving the driving unit 26, the suspension rope 23 is driven by the engagement of the traction sheave 25 with the unit 26, so that the elevator car 21 and the balance weight 28 suspended by the suspension rope 23 rise and fall in opposite directions under the guidance of the guide rails 20*a*, 20*b*; 27*a*, 27*b*, respectively. Then, since the elevator car 21 is suspended by the suspension rope 23 through the turning sheave 22*a*, 22*b* disposed on the side faces 21*a*, 21*e* under the ceiling face 21*c*, the elevator car 21 can be elevated in a manner that the ceiling face 21*c* moves upward in excess of the driving unit 26 in the elevator path 24.

Thus, according to the embodiment, since the elevator car 21 hung by the suspension rope 23 also performs an action like a moving pulley, it is possible to reduce the power capacity required for the driving unit 26. Repeatedly since the driving unit 26 having the traction sheave 25 is arranged in a space in the elevator path 24, between the side wall 24*a* of the elevator path 24 and the space being occupied by the rising and falling elevator car 21 and additionally, the elevator car 21 can rise and fall close to the ceiling and floor of the elevator path 24 without requiring any more space above or beneath the path 24, it is possible to establish the height of the path 24 to a minimum. Furthermore, the elevator apparatus of the embodiment has the advantage of freely establishing the positions of the turning sheaves 22*a*, 22*b* attached on the side faces 21*a*, 21*e* of the elevator 21 respectively, together with the positions of the accompanying turning sheaves 22*c*, 22*d* on the floor face 21*f*.

11th. Embodiment

Figure 21:
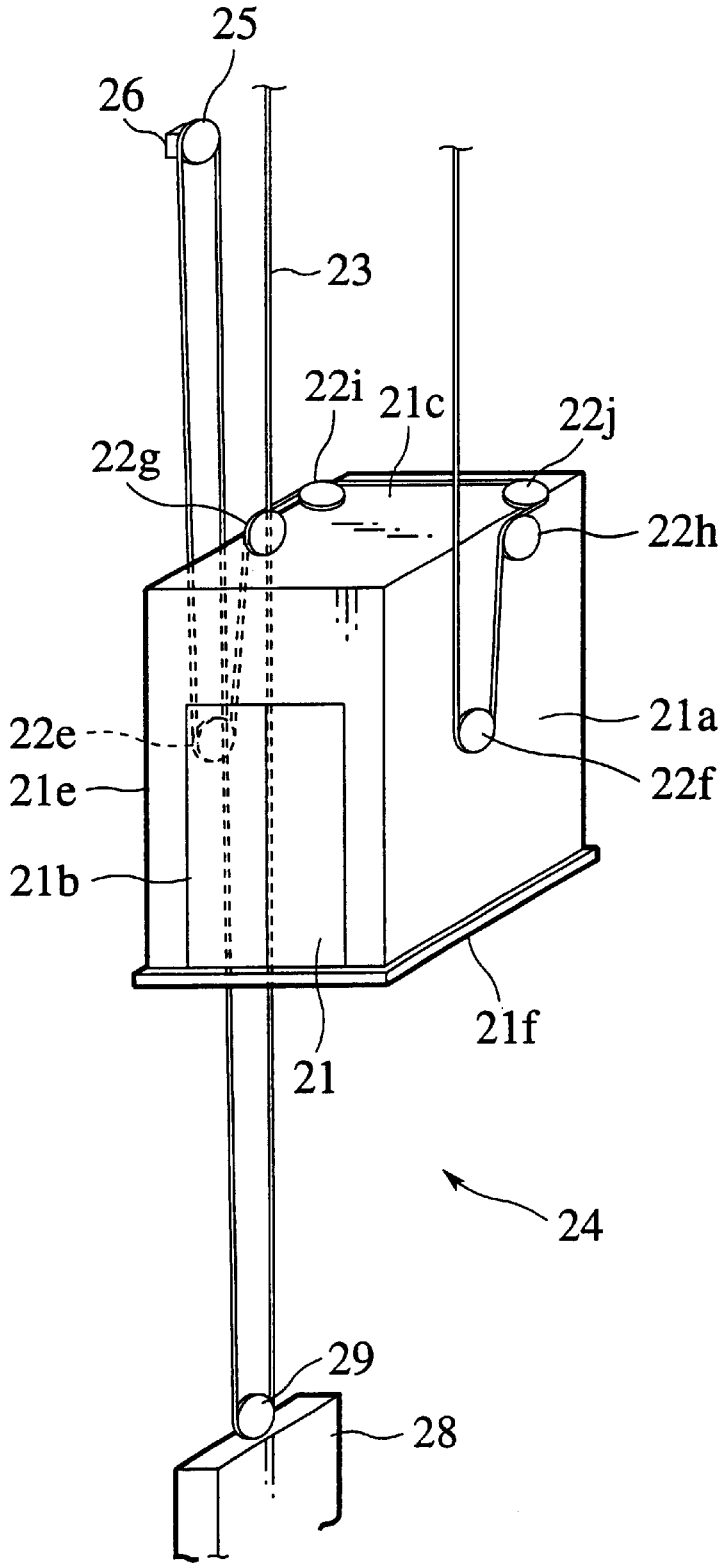
FIG. 21 is a perspective view of an essential part of the elevator apparatus in accordance with the eleventh embodiment of the invention.

Referring to FIG. 21, we now describe the elevator apparatus in accordance with the eleventh embodiment. The eleventh embodiment is characterized by the arrangement where the turning sheaves are disposed on both side faces 21*a*, 21*e* and the ceiling face 21*c* so as to be vertically opposite to the arrangement of the tenth embodiment. In detail, the turning sheaves 22*e*, 22*f* are arranged in the vicinity of the respective centers of the left and right side faces 21*a*, 21*e* of the car 21, while the turning sheaves 22*g*, 22*h* are arranged in the vicinity of the upper edges of the left and right side faces 21*a*, 21*e*. Further, in the vicinity of left and right ends of the ceiling face 21*c*, the turning sheaves 22*a*, 22*j* are attached to the ceiling face 21*c* so that the rotating planes are parallel with the ceiling face 21*c*. As to the mutual arrangement of the balance weight 28, the driving unit 26 and the traction sheave 25, this embodiment is similar to the previously-mentioned tenth embodiment.

Also in this embodiment, since the elevator car 21 hung by the suspension rope 23 also performs an action like a moving pulley, it is possible to reduce the power capacity required for the driving unit 26. Repeatedly since the driving unit 26 having the traction sheave 25 is arranged in a space in the elevator path 24, between the side wall 24*a* of the elevator path 24 and the space being occupied by the rising and falling elevator car 21 and additionally, the elevator car 21 can rise and fall close to the ceiling and floor of the elevator path 24 without requiring any more space above or beneath the path 24, it is possible to establish the height of the path 24 to a minimum. Furthermore, the elevator apparatus of the embodiment has the advantage of freely establishing the positions of the turning sheaves 22*e*, 22*f*, 22*g*, 22*h* attached on the side faces 21*a*, 21*e* of the elevator 21 respectively, together with the positions of the accompanying turning sheaves 22*a*, 22*j* on the ceiling face 21*c*.

12th. Embodiment

Figure 22:
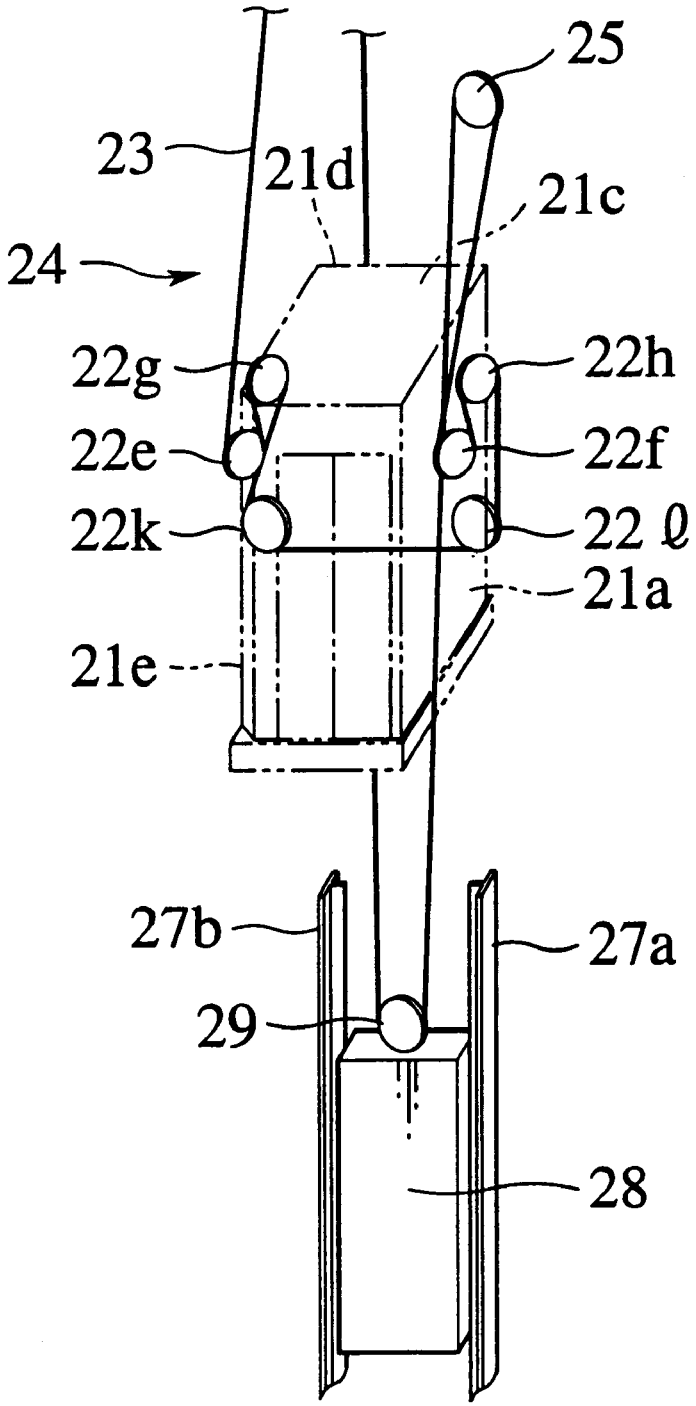
FIG. 22 is a perspective view of an essential part of the elevator apparatus in accordance with the twelfth embodiment of the invention.
Figure 23:
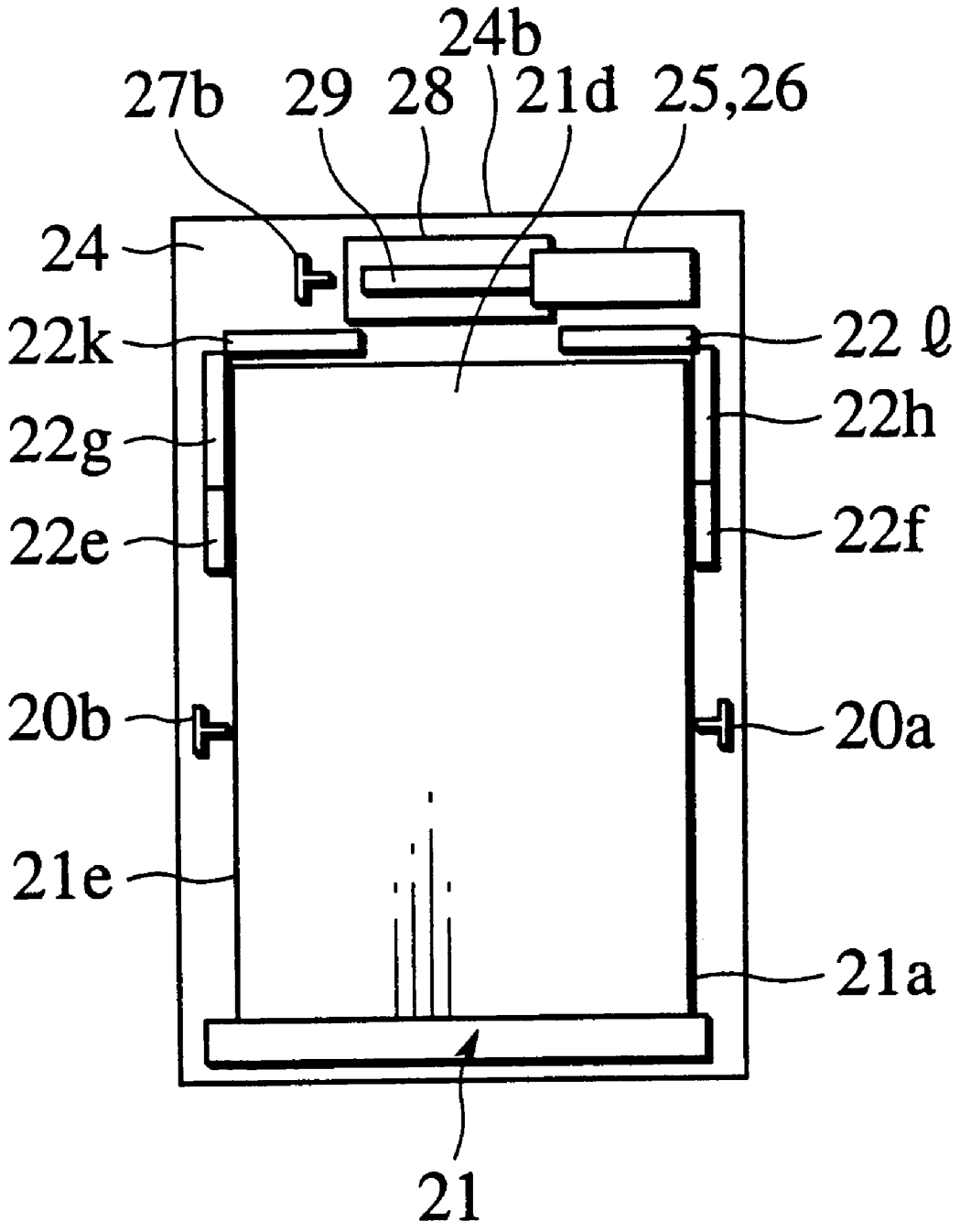
FIG. 23 is a plan view of the elevator apparatus of FIG. 22.

Referring to FIGS. 22 and 23, we now describe the elevator apparatus in accordance with the twelfth embodiment. The twelfth embodiment is characterized by the arrangement where turning sheaves 22*k* and 22*l* in place of the above turning sheaves 22*i*, 22*j* in the eleventh embodiment of FIG. 21 are disposed on the back face 21*d*. Further, positioned in the clearance between the back wall of the elevator path 24 and the space being occupied by the rising and falling elevator car 21 are not only the driving unit 26 and the traction sheave 25 but the elevating balance weight 28.

Also in this embodiment, it is possible to reduce the power capacity required for the driving unit 26, as similar to the eleventh embodiment. Repeatedly, the driving unit 26 having the traction sheave 25 is arranged in the clearance defined between the back wall of the elevator path 24 and the space being occupied by the rising and falling elevator car 21. Additionally, the elevator car 21 can rise and fall close to the ceiling and floor of the elevator path 24 without requiring any more space above or beneath the path 24. Therefore, it is possible to establish the height of the path 24 to a minimum. Furthermore, the elevator apparatus of the embodiment has the advantage of freely establishing the positions of the turning sheaves 22*e*, 22*f*, 22*g*, 22*h* attached on the side faces 21*a*, 21*e* of the elevator car 21 respectively, together with the positions of the accompanying turning sheaves 22*k*, 22*l* on the back face 21*d*.

13th. Embodiment

Figure 24:
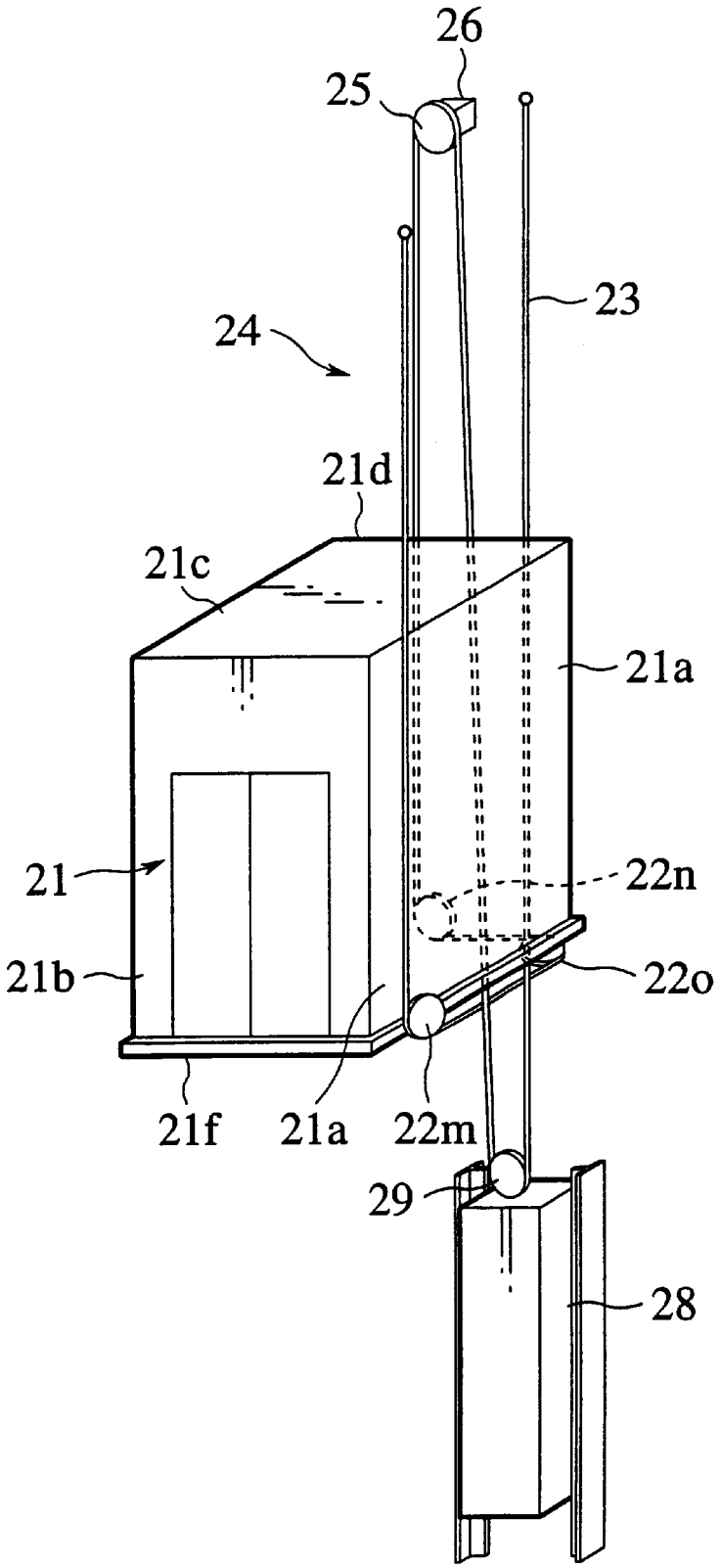
FIG. 24 is a perspective view of an essential part of the elevator apparatus in accordance with the thirteenth embodiment of the invention.
Figure 25:
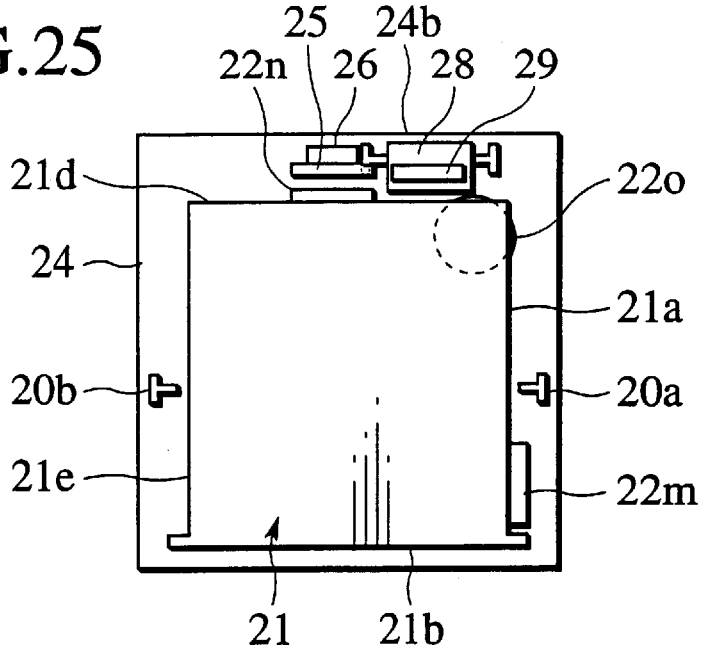
FIG. 25 is a plan view of the elevator apparatus of FIG. 24.

Referring to FIGS. 24 and 25, we now describe the elevator apparatus in accordance with the thirteenth embodiment. According to the embodiment, the elevator car 21 has a turning sheave 22*m* attached to the side face 21*a* on the right side in the view from the front side, a turning sheave 22*n* attached to the back face 21*d*, and a turning sheave 22*o* attached on the floor face 21*f*, for rotating in a rotational plane in parallel with the face 21*f*. Further, the driving unit 26 and the traction sheave 25 are positioned in the clearance defined between the back wall of the elevator path 24 and the space being occupied by the rising and falling elevator car 21. Similarly, the elevating balance weight 28 is arranged so as to rise and fall in the same clearance. The suspension rope 23 is wound round the turning sheaves 22*m*, 22*n*, 22*o*, the turning sheave 29 for the balance weight 28 and the traction sheave 25, so that both ends of the rope 23 are connected to the supporting members (not shown) on the ceiling of the elevator path 24.

Also in the thirteenth embodiment, it is possible to reduce the power capacity required for the driving unit 26, as similar to the previous embodiments. Repeatedly, since the driving unit 26 having the traction sheave 25 is arranged in the clearance defined between the back wall of the elevator path 24 and the space being occupied by the rising and falling elevator car 21, it is possible to establish the height of the path 24 to a minimum. Furthermore, the elevator apparatus of the embodiment has the advantage of freely establishing the positions of the turning sheaves 22*m*, 22*n*, 22*o* which are attached on the respective faces 21*a*, 21*d*, 21*f* of the elevator car 21, respectively.

14th. Embodiment

Figure 26:
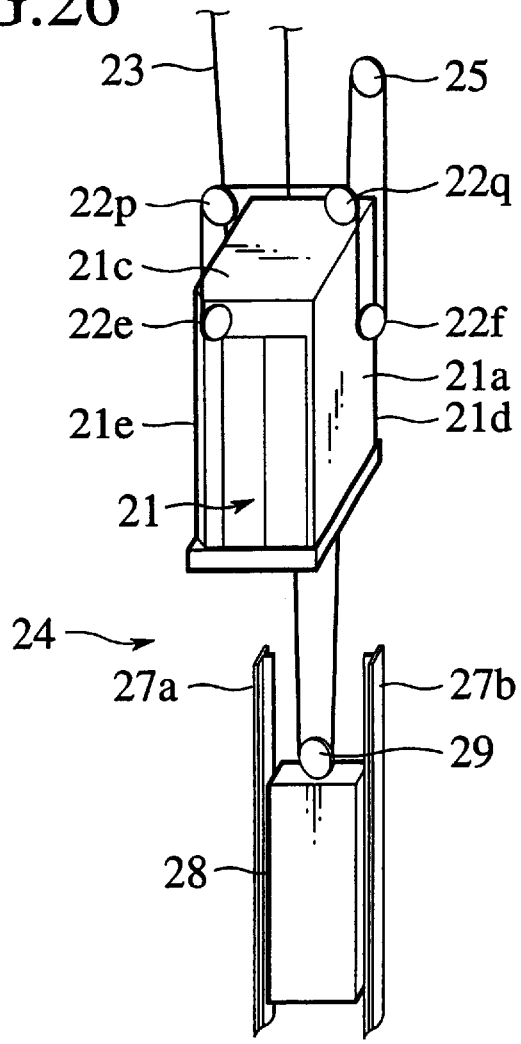
FIG. 26 is a perspective view of an essential part of the elevator apparatus in accordance with the fourteenth embodiment of the invention.

Referring to FIG. 26, we now describe the elevator apparatus in accordance with the fourteenth embodiment. In place of the turning sheaves 22*g*, 22*h* on the side faces 21*a*, 21*e* and the turning sheaves 22*k*, 22*l* on the back faces 21*d* of the twelfth embodiment shown in FIGS. 22 and 23, the twelfth embodiment is characterized by the arrangement where turning sheaves 22*p*, 22*q* are attached on both sides of the ceiling face 21*c* so that the rotating planes of the sheaves 22*p*, 22*q* are identical to substantially-vertical planes on both sides of the car 21, while the suspension rope 23 is wound round the turning sheaves 22*e*, 22*f*, 22*p*, 22*q* and the turning sheave 29 on the top of the balance weight 28.

According to the embodiment, the elevator apparatus operates and produces the similar effects to that of the twelfth embodiment. Additionally, it has the advantage of reducing the number of turning sheaves, i.e. four sheaves.

15th. Embodiment

Figure 27:
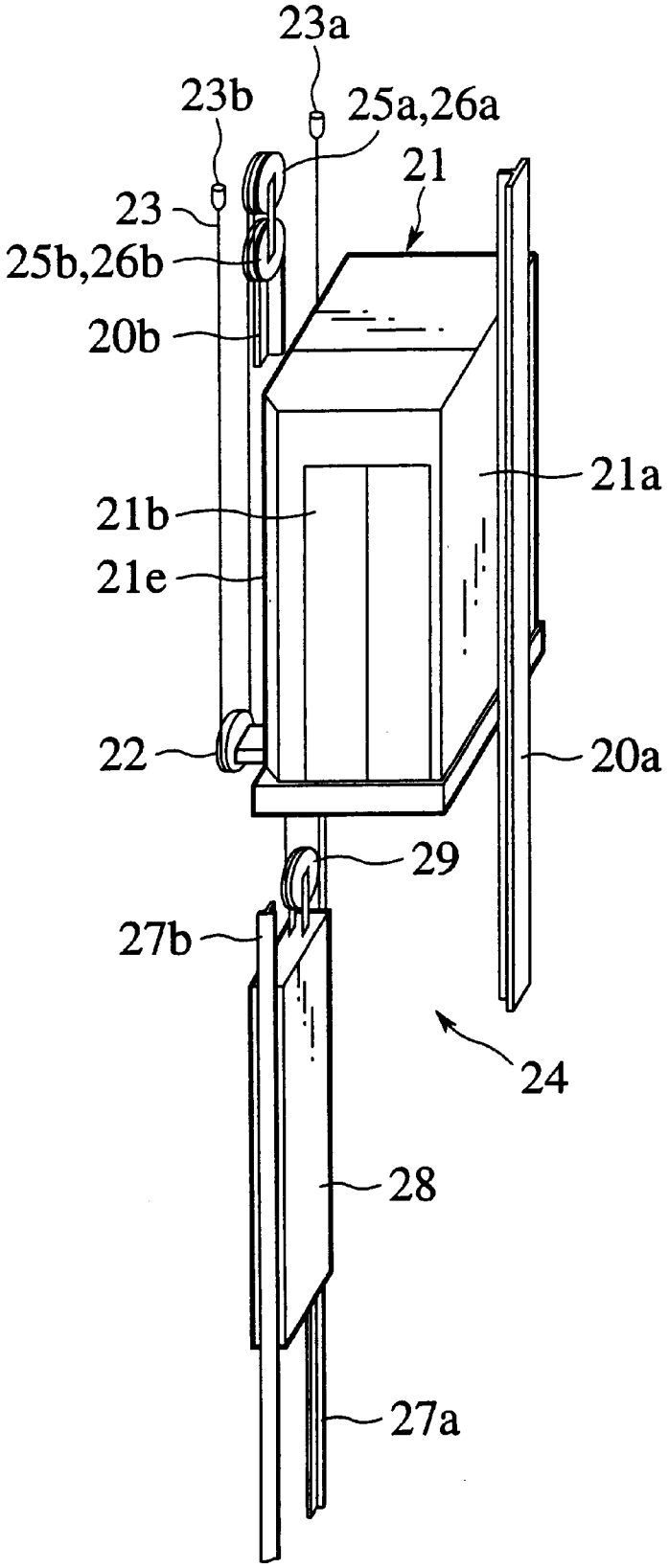
FIG. 27 is a perspective view of an essential part of the elevator apparatus in accordance with the fifteenth embodiment of the invention.

Referring to FIG. 27, we now describe the elevator apparatus in accordance with the fifteenth embodiment. In place of the driving unit 26 of FIG. 16, the fifteenth embodiment is characterized by the adoption of a plurality of driving units 26*a*, 26*b* to be operated synchronously. That is, the driving units 26*a*, 26*b* respectively including the traction sheaves 25*a*, 25*b* are mounted on the upper end of the guide rail 20*b*, for winding or rewinding the sheaves 25*a*, 25*b* synchronously.

The suspension rope 23 is wound round the turning sheave 29 on the balance weight 28, while one end 23*a* of the rope 23 is connected to the ceiling of the elevator path 24. By way of an upper half periphery of the upper traction sheave 25*a*, a lower half periphery of the lower traction sheave 25*b*, the upper half periphery of the upper traction sheave 25*a* again and the turning sheave 22 on the side face 21*e* of the car 21 in order, the other end 23*b* of the rope 23 is finally connected to the ceiling of the elevator path 24. With the above-mentioned wiring, it is possible to equally wind the suspension rope 23 about two traction sheaves 25*a*, 25*b* by three quarters of the whole periphery of each sheave. Note, the upper traction sheave 25*a* is provided, for receiving the suspension rope 23, with a groove whose width is twice as large as that of the lower traction sheave 25*b*.

According to the fifteenth embodiment of the invention, since the driving units 26*a*, 26*b* operate to wind the suspension rope 23, it is possible to double the thrust for driving the elevator car 21 thereby to cope with the driving of a large capacity of elevator car 21.

Figure 28:
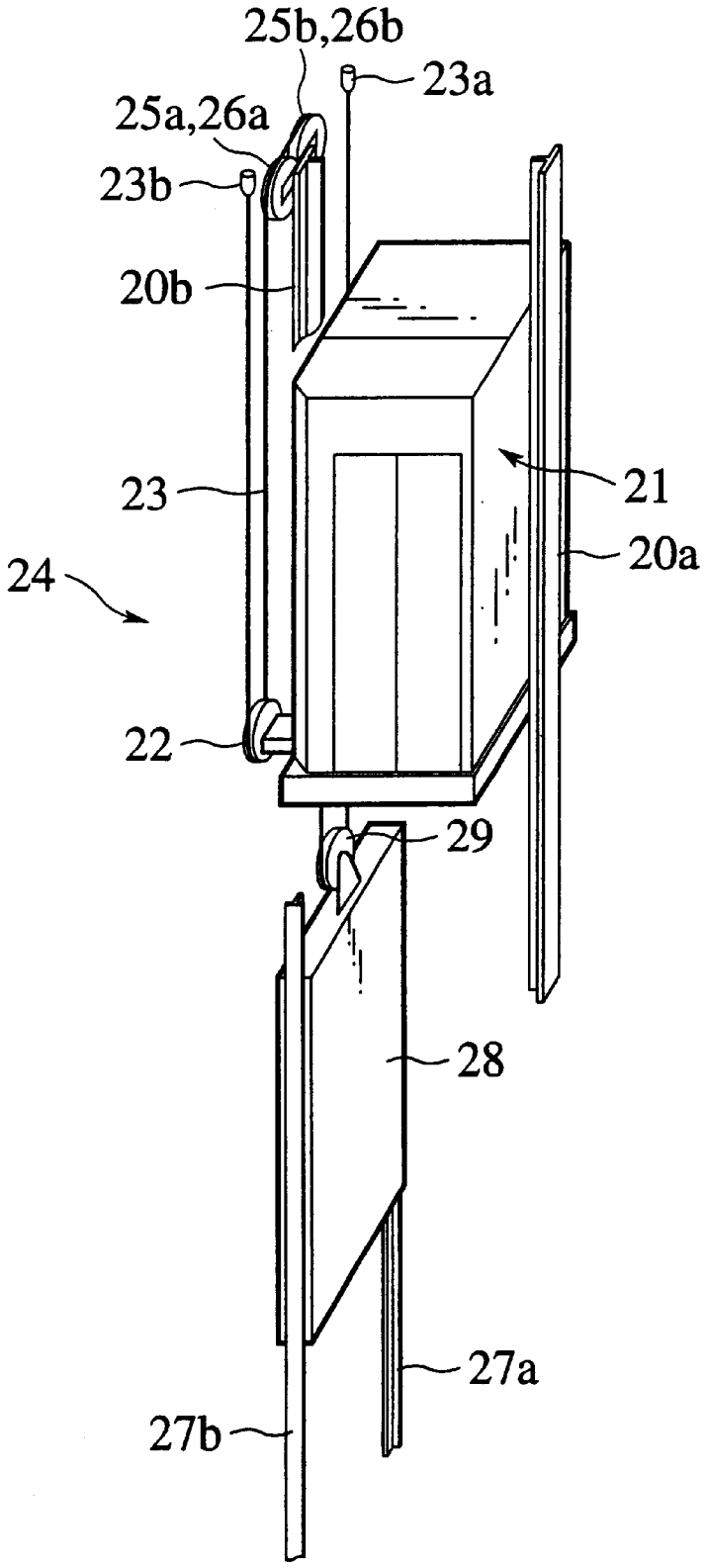
FIG. 28 is a perspective view of an essential part of the elevator apparatus in the modification of the embodiment of FIG. 27.

In connection, the driving units 26*a*, 26*b* may be arranged horizontally, as shown in the modification of FIG. 28. In this case, the suspension rope 23 is successively brought to the upper part (one fourth of the whole periphery) of the front traction sheave 25*a* from the underside, the sequential rear half round of the rear traction sheave 25*b*, the half round of the front traction sheave 25*a* from the underside again and the upper part (one fourth of the whole periphery) of the rear traction sheave 25*b* again and thereafter, to the downside. Finally, the rope 23 is wound round the turning sheave 22 on the side face 21*e* of the car 21. In this way, it is possible to equally wind the suspension rope 23 about two traction sheaves 25*a*, 25*b* by three quarters of the whole periphery of each sheave.

Note, the above-mentioned arrangement of juxtaposing the plural driving units and winding the suspension rope round the corresponding traction sheaves is applicable to any one of the previously-mentioned embodiments adopting the single driving unit 26.

Furthermore, if adopting the plural driving units in such a way, the synchronous control of the units by the single control device would prevent the structure of the apparatus from being complicated.

16th. Embodiment

Figure 29:
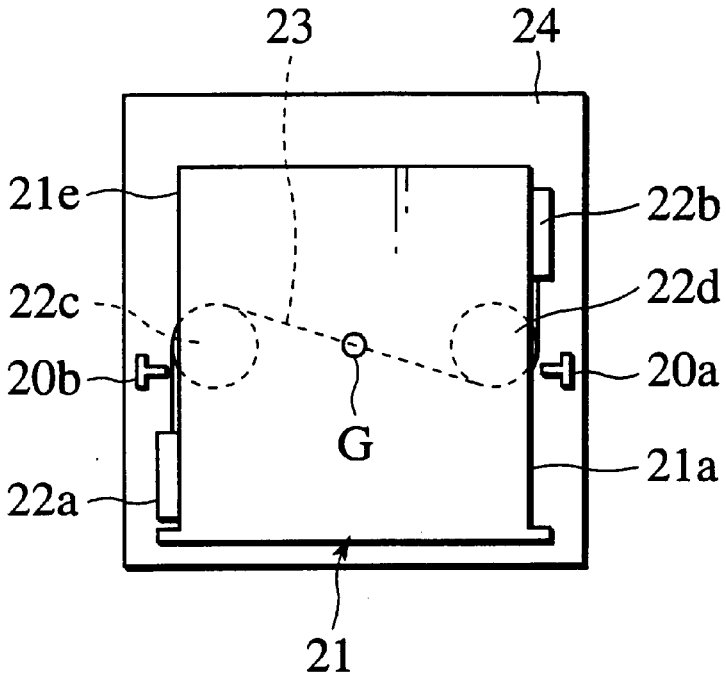
FIG. 29 is a perspective view of an essential part of the elevator apparatus in accordance with the sixteenth embodiment of the invention.
Figure 30:
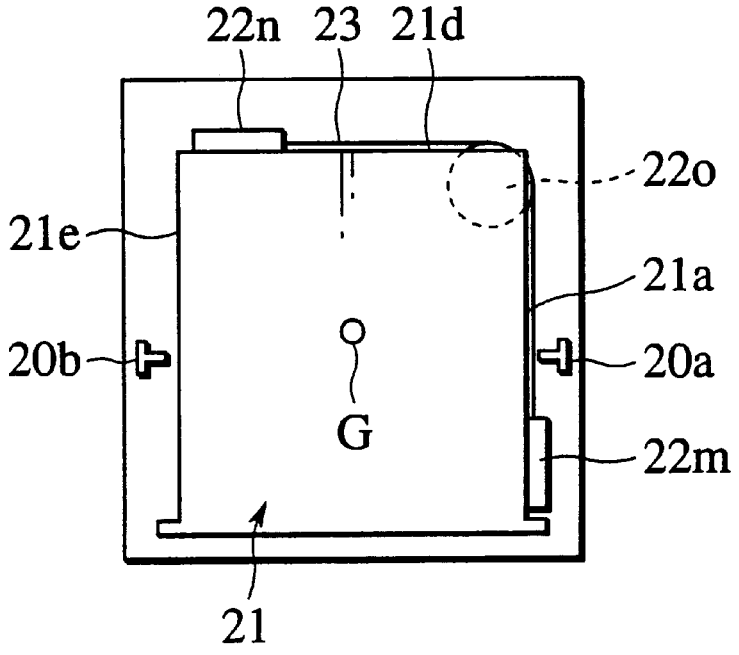
FIG. 30 is a perspective view of an essential part of the elevator apparatus in the modification of the embodiment of FIG. 29.

Referring to FIGS. 29 and 30, we now describe the elevator apparatus in accordance with the sixteenth embodiment. In case of the tenth to fourteenth embodiments where the turning sheaves are mounted on both side faces 21*a*, 21*e* of the elevator car 21 or the side faces 21*a*, 21*e* and the back face 21*d* or the roof face 21*c*, the turning sheaves 22*a* to 22*d* may be arranged in symmetry about the gravity center G of the car 21, as shown with the symmetrical arrangement (of 180 degrees) of FIG. 29, representatively.

Additionally, even when the turning sheaves 22*m*, 22*n*, 22*o* are attached on the side faces 21*a*, 21*d* and the bottom face 21*f* respectively, the turning sheaves may be symmetrically arranged with respect to the gravity center G of the elevator car 21, for example, as shown with the symmetrical arrangement (of 90 degrees) of FIG. 30.

With the symmetrical arrangement, it is possible to suspend the elevator car 21 in a manner to interpose the gravity center G. Thus, it is possible to prevent an excessive bias load from acting on the guide rails 20*a*, 20*b*, whereby the stable rise and fall can be accomplished.

Note, as to the above-mentioned embodiments where the driving unit, the traction sheaves and the balance weight are collectively disposed on either one of the right and left sides of the apparatus, of course, such elements may be disposed on the opposite side of the apparatus in the modification.

Finally, it will be understood by those skilled in the art that the foregoing descriptions are related to some preferred embodiments of the elevator apparatus of the invention, and that various changes and modifications may be made to the present invention without departing from the spirit and scope thereof.

What is claimed is:

1. An elevator apparatus comprising:

a pair of elevator guide rails disposed in an elevator path;

an elevator car for rising and falling along the elevator guide rails in the elevator path;

weight guide rails disposed in an elevator path;

at least one balance weight for rising and falling along the weight guide rails in the elevator path;

at least one suspension rope having one end fixed to the elevator car and another end fixed to the balance weight; and at least one driving unit for driving a traction sheave about which the suspension rope is wound;

wherein the driving unit is disposed in a pit of the elevator path; and wherein both ends of the suspension rope wound about the traction sheave are fixed to the elevator car's position below a ceiling of the elevator car and the balance weight through respective turning sheaves which are positioned above the elevator path.

* * * * *